US010459388B2

(12) United States Patent
Ishida et al.

(10) Patent No.: US 10,459,388 B2
(45) Date of Patent: Oct. 29, 2019

(54) IMAGE FORMING APPARATUS AND RECORDING MATERIAL DETERMINATION APPARATUS

(71) Applicant: CANON KABUSHIKI KAISHA, Tokyo (JP)

(72) Inventors: Tsutomu Ishida, Suntou-gun (JP); Tomohiro Hashimoto, Numazu (JP); Masafumi Monde, Kawasaki (JP); Norio Matsui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/354,737

(22) Filed: Nov. 17, 2016

(65) Prior Publication Data

US 2017/0146939 A1 May 25, 2017

(30) Foreign Application Priority Data

Nov. 19, 2015 (JP) ..... 2015-226904
Nov. 19, 2015 (JP) ..... 2015-226905
Sep. 13, 2016 (JP) ..... 2016-178611

(51) Int. Cl.
*G03G 15/00* (2006.01)

(52) U.S. Cl.
CPC ..... *G03G 15/5029* (2013.01); *G03G 15/5062* (2013.01); *G03G 15/65* (2013.01)

(58) Field of Classification Search
None
See application file for complete search history.

(56) References Cited

U.S. PATENT DOCUMENTS

2003/0202214 A1* 10/2003 Akita ..... G06K 15/021 358/3.24
2008/0169438 A1* 7/2008 Murata ..... B41J 11/009 250/559.07
2008/0181693 A1* 7/2008 Cobene ..... G03G 15/5029 399/361
2010/0259772 A1* 10/2010 Ebihara ..... B41J 11/009 358/1.9

(Continued)

FOREIGN PATENT DOCUMENTS

JP H0725500 A 1/1995
JP 2003274204 A 9/2003

(Continued)

*Primary Examiner* — Thomas S Giampaolo, II
(74) *Attorney, Agent, or Firm* — Canon U.S.A., Inc. I.P. Division

(57) ABSTRACT

Various embodiments include an image forming unit configured to form an image on a recording material, an illumination unit configured to emit light, an image capturing unit configured to capture light emitted by the illumination unit and reflected by the recording material as a surface image including a plurality of pixels, and a control unit configured to calculate a first feature quantity from a difference of output values of a plurality of pixels arranged in a first direction, and calculate a second feature quantity from a difference of output values of a plurality of pixels arranged in a second direction intersecting the first direction in the surface image captured by the image capturing unit, and control an image forming condition of the image forming unit based on the calculated first feature quantity and the calculated second feature quantity.

20 Claims, 31 Drawing Sheets

(56) References Cited

U.S. PATENT DOCUMENTS

| | | | | |
|---|---|---|---|---|
| 2013/0234385 | A1* | 9/2013 | Suzuki | G03G 15/6511 271/18.1 |
| 2014/0037351 | A1* | 2/2014 | Matsui | G03G 15/50 399/389 |
| 2014/0341598 | A1* | 11/2014 | Kobayashi | G03G 15/5029 399/45 |
| 2015/0036190 | A1* | 2/2015 | Fukasawa | G06K 15/1806 358/1.15 |

FOREIGN PATENT DOCUMENTS

| | | | |
|---|---|---|---|
| JP | 2004050815 | A | 2/2004 |
| JP | 2009-141777 | A | 6/2009 |
| JP | 2009128822 | A | 6/2009 |
| JP | 2009-258479 | A | 11/2009 |
| JP | 2010-128364 | A | 6/2010 |
| JP | 2010283670 | A | 12/2010 |
| JP | 2011079202 | A | 4/2011 |
| JP | 2011137938 | A | 7/2011 |
| JP | 2011-191504 | A | 9/2011 |
| JP | 2013-236186 | A | 11/2013 |
| JP | 2014-099918 | A | 5/2014 |
| JP | 2015023562 | A | 2/2015 |

* cited by examiner

IN THE CASE OF LONGITUDINAL CONVEYANCE

IN THE CASE OF LATERAL CONVEYANCE

FIG.8

| AVERAGE OF ORTHOGONAL DIFFERENCE INTEGRATION AND PARALLEL DIFFERENCE INTEGRATION | TEMPERATURE (°C) |
|---|---|
| 500 ≤ ~ < 550 | 175 |
| 550 ≤ ~ < 600 | 180 |
| 600 ≤ ~ < 650 | 185 |

FIG.11

| PARALLEL DIFFERENCE INTEGRATION | RATIO OF PARALLEL DIFFERENCE INTEGRATION AND ORTHOGONAL DIFFERENCE INTEGRATION | TEMPERATURE (°C) |
|---|---|---|
| 200 ≤ ~ < 400 | 1.3 ≤ ~ < 1.45 | 173 |
| 200 ≤ ~ < 400 | 1.15 ≤ ~ < 1.3 | 174 |
| 200 ≤ ~ < 400 | 1.0 ≤ ~ < 1.15 | 175 |
| 200 ≤ ~ < 400 | 0.85 ≤ ~ < 1.0 | 176 |
| 200 ≤ ~ < 400 | 0.7 ≤ ~ < 0.85 | 177 |
| 400 ≤ ~ < 600 | 1.3 ≤ ~ < 1.45 | 177 |
| 400 ≤ ~ < 600 | 1.15 ≤ ~ < 1.3 | 179 |
| 400 ≤ ~ < 600 | 1.0 ≤ ~ < 1.15 | 180 |
| 400 ≤ ~ < 600 | 0.85 ≤ ~ < 1.0 | 181 |
| 400 ≤ ~ < 600 | 0.7 ≤ ~ < 0.85 | 182 |
| 600 ≤ ~ < 800 | 1.3 ≤ ~ < 1.45 | 182 |
| 600 ≤ ~ < 800 | 1.15 ≤ ~ < 1.3 | 183 |
| 600 ≤ ~ < 800 | 1.0 ≤ ~ < 1.15 | 185 |
| 600 ≤ ~ < 800 | 0.85 ≤ ~ < 1.0 | 186 |
| 600 ≤ ~ < 800 | 0.7 ≤ ~ < 0.85 | 187 |

A3, LONG GAIN,
LONGITUDINAL CONVEYANCE

A3, SHORT GAIN,
LONGITUDINAL CONVEYANCE

A4, LONG GAIN,
LONGITUDINAL CONVEYANCE

A4, LONG GAIN,
LATERAL CONVEYANCE

A4, SHORT GAIN,
LONGITUDINAL CONVEYANCE

A4, SHORT GAIN,
LATERAL CONVEYANCE

IMAGE FORMING APPARATUS AND RECORDING MATERIAL DETERMINATION APPARATUS

BACKGROUND

Field of the Invention

The present invention relates to a technique for determining a type of a recording material with high accuracy and controlling an image forming condition according to a determination result.

Description of the Related Art

Conventionally, in some cases, image forming apparatuses, such as copying machines and printers, include sensors for determining types of recording materials within the image forming apparatuses. These apparatuses can automatically determine the types of the recording materials and control transfer conditions (i.e., transfer voltages and conveyance speeds of the recording materials at the time of transfer) and fixing conditions (i.e., fixing temperatures and the conveyance speeds of the recording materials at the time of fixing) according to the determined results.

Japanese Patent Application Laid-Open No. 2010-283670 describes an image forming apparatus provided with a recording material determination unit which illuminates a recording material with light and captures the light reflected on the recording material as an image by a complementary metal oxide semiconductor (CMOS) sensor to determine a type of the recording material. The image forming apparatus controls a transfer voltage, a fixing temperature, and a conveyance speed, of the recording material according to the type of the recording material determined by the recording material determination unit. Based on such a process, a high quality image can be formed on the recording material.

Generally, there are two setting methods when recording materials are set in a cassette and the like of an image forming apparatus. One method is for setting the recording materials so as to be conveyed to a direction parallel to a long side direction of the recording material and the other method is for setting the recording materials so as to be conveyed to a direction parallel to a short side direction of the recording material. The former is referred to as a longitudinal conveyance state and the latter is referred to as a lateral conveyance state.

In addition, it is known that a recording material has a predetermined fiber direction (also referred to as a grain direction) depending on its type. When a same recording material is captured by a CMOS sensor in the longitudinal conveyance state and the lateral conveyance state, different images are respectively captured according to a difference in a fiber direction of the recording material. Accordingly, despite the same type of the recording material, it may be erroneously determined as a different type of the recording material. When such errors occur, an image may be formed using an image forming condition not suitable for the recording material, and an image quality may be lowered in some cases.

Japanese Patent Application Laid-Open No. 2010-283670 describes a configuration which includes two light sources for illuminating a recording material with light from different directions for suppressing influence of a fiber direction of the recording material. The two light sources are configured so that the directions of the light emitted therefrom are orthogonal to each other. Further, according to Japanese Patent Application Laid-Open No. 2010-283670, two images obtained by the two light sources are used to determine a type of the recording material and to determine an image forming condition.

The configuration described in Japanese Patent Application Laid-Open No. 2010-283670 can reduce the influence on determination accuracy of the fiber direction of the recording material. However, the necessity to provide two light sources causes increase in the cost of the image forming apparatus.

SUMMARY OF THE INVENTION

Various embodiments of the present application are directed to the provision of an image forming apparatus capable of determining a type of a recording material with high accuracy and forming a high quality image while suppressing influence of a fiber direction of the recording material without increasing a cost of the image forming apparatus.

According to various embodiments or the present application, an image forming apparatus includes an image forming unit configured to form an image on a recording material, an illumination unit configured to emit light, an image capturing unit configured to capture light emitted by the illumination unit and reflected by the recording material as a surface image including a plurality of pixels, and a control unit configured to calculate a first feature quantity from a difference of output values of a plurality of pixels arranged in a first direction, and calculate a second feature quantity from a difference of output values of a plurality of pixels arranged in a second direction intersecting the first direction in the surface image captured by the image capturing unit, and control an image forming condition of the image forming unit based on the calculated first feature quantity and the calculated second feature quantity.

Further features will become apparent from the following description of exemplary embodiments with reference to the attached drawings.

BRIEF DESCRIPTION OF THE DRAWINGS

FIG. 8 is a table for determining a fixing temperature according to the first exemplary embodiment.

FIG. 11 is a table for determining a fixing temperature according to the second exemplary embodiment.

DESCRIPTION OF THE EMBODIMENTS

Various exemplary embodiments will be described in detail below with reference to the attached drawings.

<Description of Image Forming Apparatus>

Figure 1:
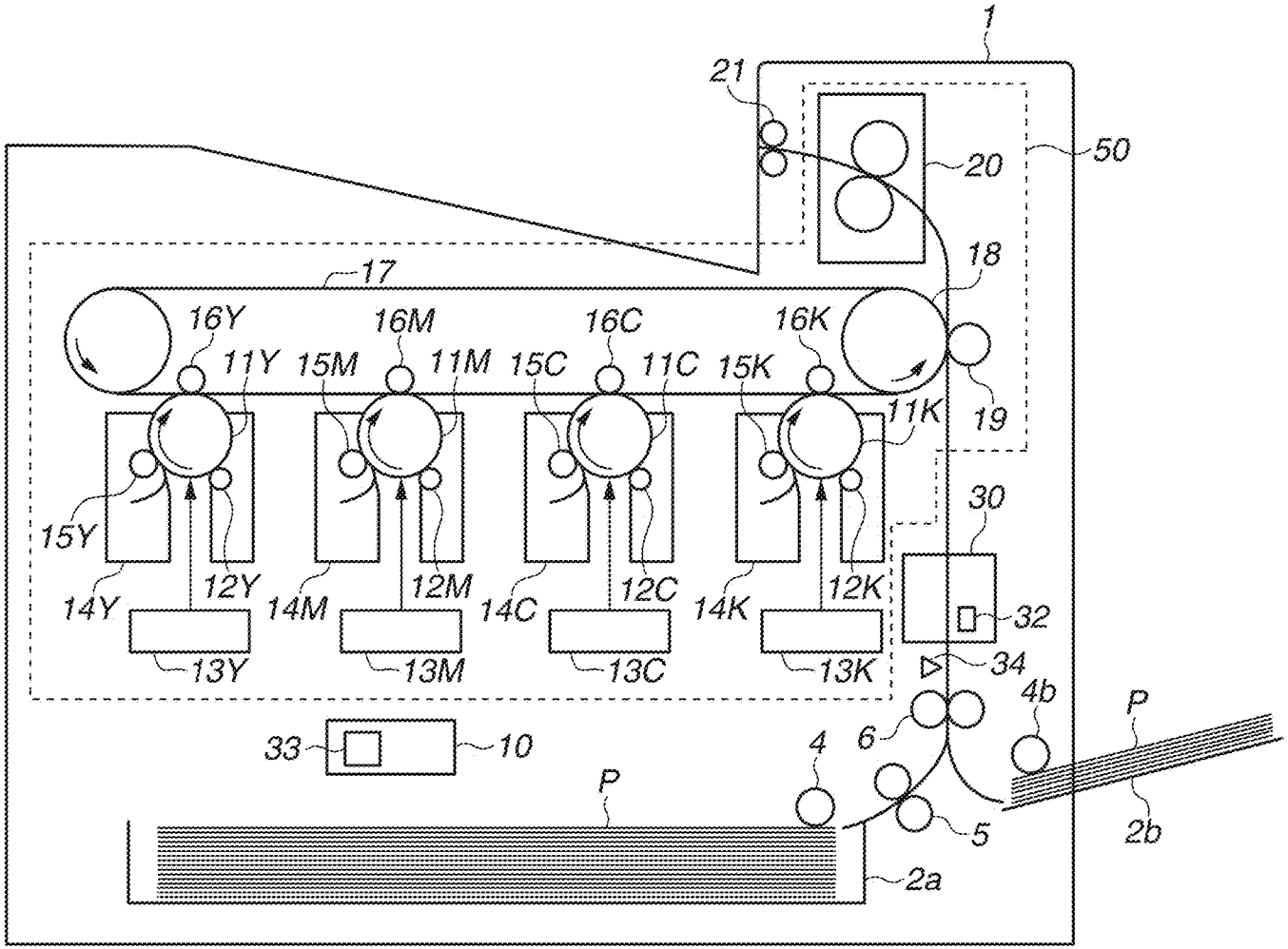
FIG. 1 illustrates a configuration of an image forming apparatus according to first to third exemplary embodiments.

According to a first exemplary embodiment, an electrophotographic method color laser beam printer 1 (hereinbelow, referred to as the printer 1) is described as an image forming apparatus. FIG. 1 is a schematic configuration drawing of the printer 1.

The printer 1 is a tandem type color printer which can form a color image on a recording paper P (a recording material) by superimposing toners as developers of four colors namely yellow (Y), magenta (M), cyan (C), and black (K). A cassette 2*a* which stores the recording paper P and a manual feed tray 2*b* which stores the recording paper P are examples of storage units. The printer 1 includes a sheet feed roller 4*a* for feeding the recording paper P from the cassette 2*a* and a sheet feed roller 4*b* for feeding the recording paper P from the manual feed tray 2*b*. The printer 1 further includes a pair of conveyance rollers 5 and a pair of registration rollers 6 for conveying the recording paper P fed by the sheet feed roller 4*a* or 4*b*. A registration sensor 34 for detecting the recording paper P is installed near the registration roller pair 6. The registration sensor 34 detects a leading edge (an edge portion on a downstream side in a conveyance direction of the recording paper P) and a trailing edge of (an edge portion on an upstream side in the conveyance direction of the recording paper P) of the recording paper P.

Photosensitive drums 11 (11Y, 11M, 11C, and 11K) bear toners and rotate to a direction of an arrow in FIG. 1 by a driving source (not illustrated). Charging rollers 12 (12Y, 12M, 12C, and 12K) uniformly charge the respective photosensitive drums 11 to predetermined potential. Laser scanners 13 (13Y, 13M, 13C, and 13K) respectively expose the charged photosensitive drums 11 with light and form electrostatic latent images on the photosensitive drums 11. Process cartridges 14 (14Y, 14M, 14C, and 14K) respectively store toners for visualizing the electrostatic latent images formed on the photosensitive drums 11. Developing rollers 15 (15Y, 15M, 15C, and 15K) respectively supply the toners stored in the process cartridges 14 to the photosensitive drums 11 and form toner images on the photosensitive drums 11.

Primary transfer rollers 16 (16Y, 16M, 16C, and 16K) primarily transfer the toner images formed on the respective photosensitive drums 11 to an intermediate transfer belt 17. The intermediate transfer belt 17 is rotated by a driving roller 18 to a direction of an arrow in FIG. 1. A secondary transfer roller (a transfer unit) 19 transfers an image formed on the intermediate transfer belt 17 to the recording paper P. A fixing device (a fixing unit) 20 melts and fixes the toner image secondarily transferred to the recording paper P while conveying the recording paper P. An image forming unit 50 for forming an image on the recording paper P includes the photosensitive drums 11 to the fixing device 20 described above. A discharge roller 21 discharges the recording paper P subjected to the fixing by the fixing device 20.

A recording material detection unit 30 (hereinbelow, referred to as the detection unit 30) detects a property of the recording paper P so as to determine a type of the recording paper P. The detection unit 30 includes a surface property detection unit 32 for detecting a surface property of the recording paper P as the property of the recording paper P. The surface property detection unit 32 includes an illumination unit 32*a*, a focusing unit 32*b*, and an image capturing unit 32*c*, which are described below, and detects the surface property (an asperity state) of the recording paper P.

A control unit 10 controls an operation of the printer 1. The control unit 10 includes a central processing unit (CPU)

33, a random access memory (RAM) (not illustrated) used for calculation, temporary storage, and the like of data necessary for controlling the printer 1, a read only memory (ROM) (not illustrated) for storing a program for controlling the printer 1 and various types of data, and the like. The role of the control unit 10 is described in detail below.

<Description of Recording Material Detection Unit>

Next, the detection unit 30 is described in detail below. FIGS. 2A to 2D each illustrate a configuration of the surface property detection unit 32 included in the detection unit 30 when the surface property detection unit 32 is viewed from three different directions.

Figure 2A:
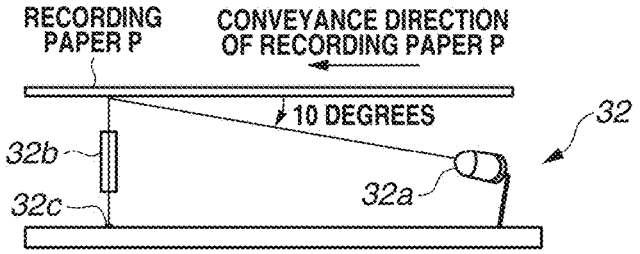
FIGS. 2A to 2D illustrate a configuration of a surface property detection unit according to the first to third exemplary embodiments.

FIG. 2A illustrates a state when the surface property detection unit 32 is viewed from a direction parallel to a conveyance surface of the recording paper P and orthogonal to the conveyance direction of the recording paper P (a width direction of the recording paper P). The surface property detection unit 32 includes the illumination unit 32*a*, the focusing unit 32*b*, and the image capturing unit 32*c*. The illumination unit 32*a* illuminates a surface of the recording paper P with light. The illumination unit 32*a* emits the light at an angle of 10 to 15 degrees with respect to the surface of the recording paper P. The focusing unit 32*b* forms an image of the light emitted from the illumination unit 32*a* and reflected on the surface of the recording paper P on the image capturing unit 32*c*. The image capturing unit 32*c* captures the image formed by the focusing unit 32*b* as a surface image of the recording paper P.

Figure 2B:
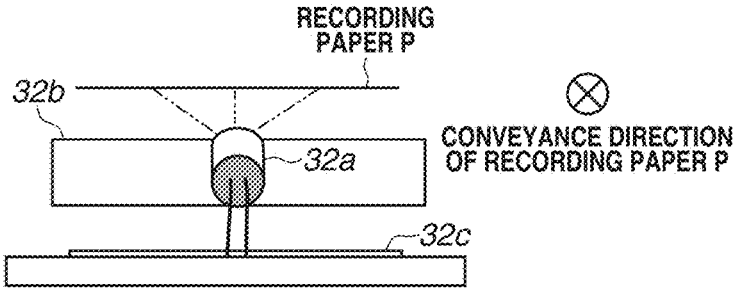
Figure 2C:
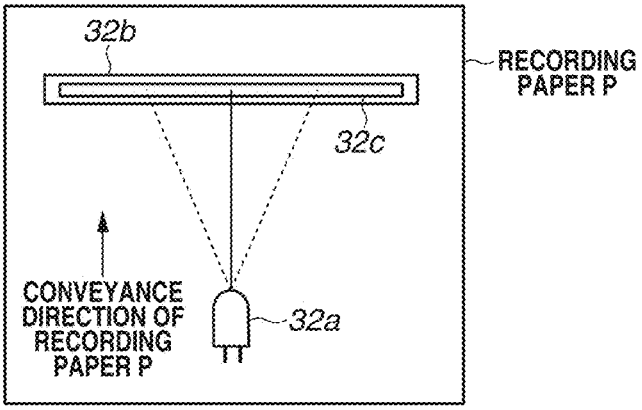
Figure 2D:
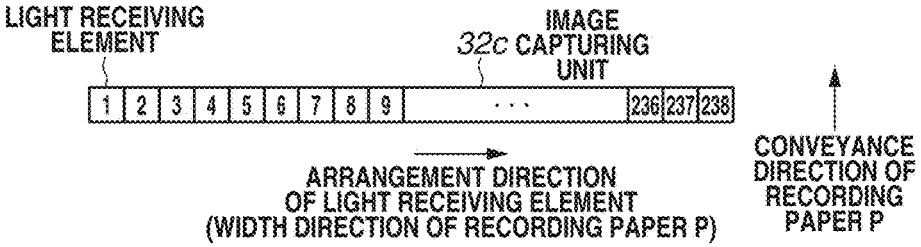

FIG. 2B illustrates a state when the surface property detection unit 32 is viewed from the upstream side of the conveyance direction of the recording paper P. FIG. 2C illustrates a state when the surface property detection unit 32 is viewed from a direction orthogonal to the conveyance surface of the recording paper P. As seen from FIGS. 2B and 2C, the illumination unit 32*a* emits the light parallel to the conveyance direction of the recording paper P. In addition, the image capturing unit 32*c* is a CMOS line sensor, and light receiving elements for receiving light are arranged 238 pieces therein as illustrated in FIG. 2D. One light receiving element corresponds to one pixel. Thus, when the CMOS line sensor captures an image once, an image of 238 pixels can be obtained. A size of an image is 42 μm*42 μm. A plurality of the light receiving elements are arranged in a line along a direction parallel to the conveyance surface of the recording paper P and orthogonal to the conveyance direction of the recording paper P (the width direction of the recording paper P). In addition, a series of image capturing operations is repeated while conveying the recording paper P, and captured linear images are connected in the conveyance direction of the recording paper P, so that the surface property detection unit 32 can obtain an image having a size of (the number of image capturing times*238 pixels).

The size of an image and the number of pixels are examples and can be appropriately set according to desired detection accuracy, a cost, or a restriction of a size. Further, the present exemplary embodiment is described using the configuration of the CMOS line sensor in which pixels are arranged only in one line. However, the present exemplary embodiment can be applied to a configuration of a CMOS area sensor in which pixels are arranged in a plurality of lines.

Figure 3:
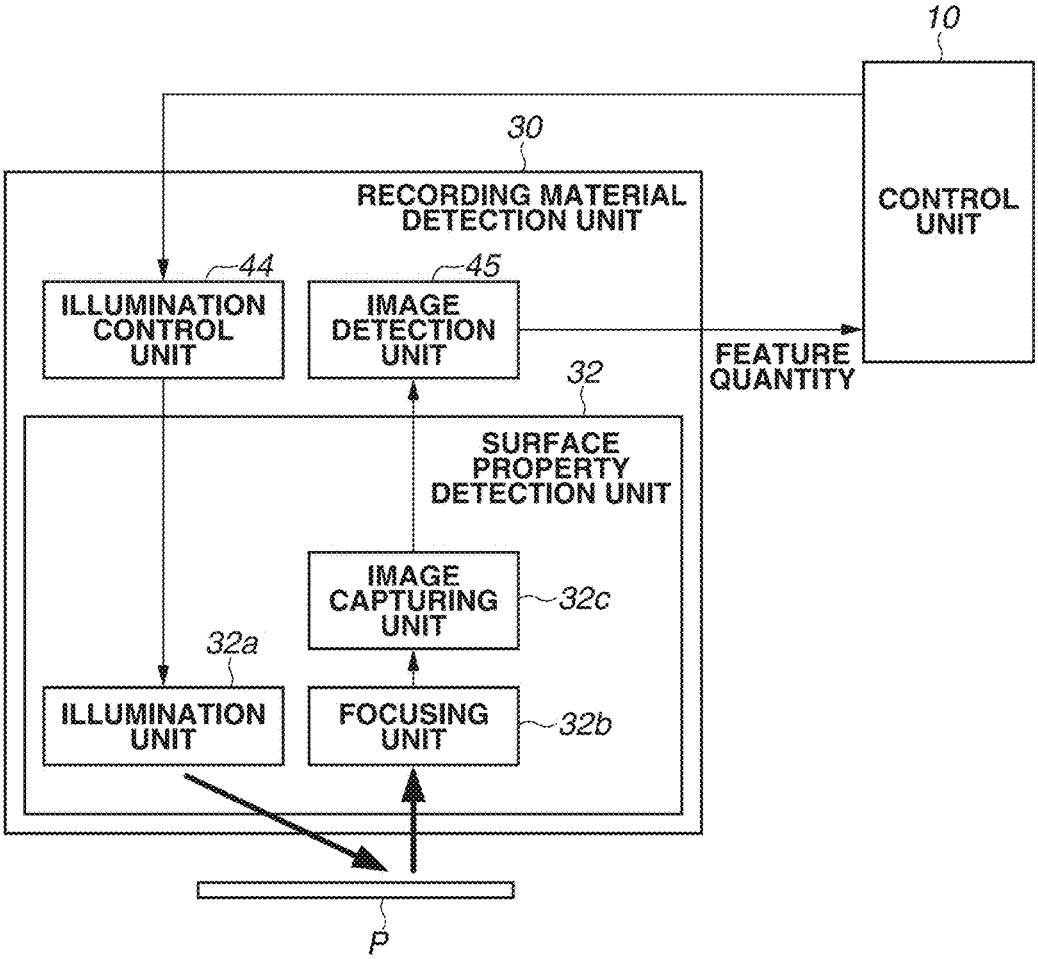
FIG. 3 is a block diagram illustrating a recording material detection unit according to the first to third exemplary embodiments.

Next, an outline of operation of the surface property detection unit 32 included in the detection unit 30 is described. FIG. 3 is a block diagram illustrating the detection unit 30. The detection unit 30 includes an illumination control unit 44 and an image detection unit 45 in addition to the above-described surface property detection unit 32.

First, when the recording paper P is conveyed to a detection position of the surface property detection unit 32 at a constant speed, the control unit 10 transmits a signal for starting a detection operation to the illumination control unit 44. The illumination unit 32*a* illuminates the surface of the recording paper P with light according to control by the illumination control unit 44. The light illuminating the recording paper P is captured as an image by the image capturing unit 32*c* via the focusing unit 32*b*. The captured image is a surface image of the recording paper P and output to the image detection unit 45. The surface image obtained here is changed according to the surface property (the asperity state) of the recording paper P. Although it is described in detail below, the image detection unit 45 calculates a feature quantity representing the surface property of the recording paper P from a depth of the asperity in the surface image and outputs the feature quantity to the control unit 10. When obtaining the feature quantity, the control unit 10 transmits a signal for stopping the detection operation to the illumination control unit 44. The control unit 10 determines a type (a surface property) of the recording paper P from the obtained feature quantity and controls the image forming condition of the image forming unit 50 in response to the determined type.

For example, when a thickness is the same, a recording paper P referred to as a coated paper having a smooth surface has a resistance value lower that of a recording paper P referred to as a rough paper having a rough surface. Thus, the coated paper requires a greater transfer current and a higher transfer voltage for transferring a toner image compared to the rough paper. Further, the coated paper requires a lower fixing temperature and a shorter fixing time for fixing the toner image compared to the rough paper, so that it is necessary to change fixing conditions, such as the fixing temperature and the conveyance speed of the recording paper P. As described above, various image forming conditions are controlled according to the type of the recording paper P, and thus a quality of an image formed on the recording paper P can be improved.

The image forming conditions may further include, for example, the conveyance speed of the recording paper P, voltage values applied to the primary transfer rollers 16 and the secondary transfer roller 19, a temperature when the fixing device 20 fixes an image on the recording paper P, and the like. The control unit 10 may control rotation speeds of the primary transfer rollers 16 and the secondary transfer roller 19 when transferring an image as the image forming conditions. Further, the control unit 10 may control a rotation speed of a fixing roller included in the fixing device 20 when fixing an image as the image forming condition. Furthermore, the control unit 10 may directly control the image forming condition from a value of the calculated feature quantity without determining the type of the recording paper P.

<Description of Fiber Direction of Recording Material>

Figure 4A:
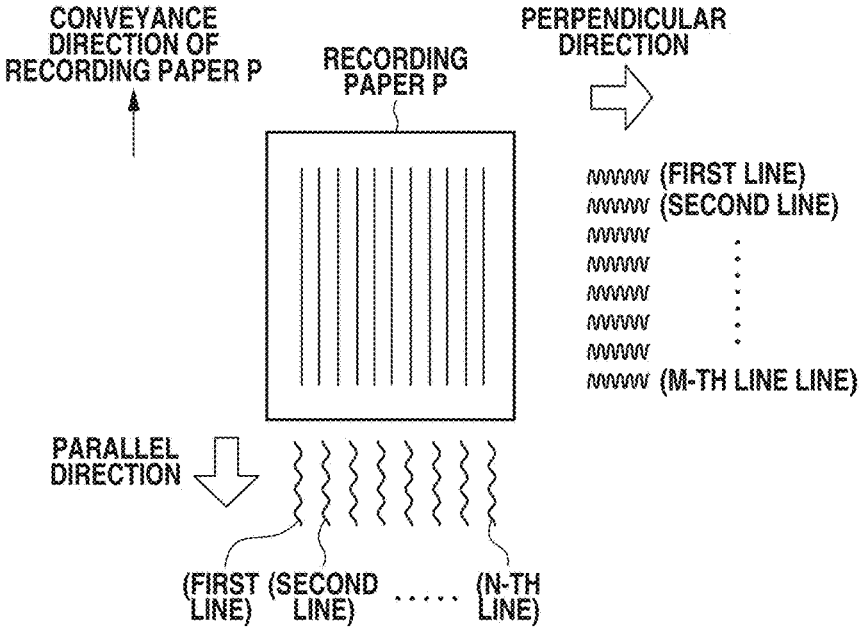
FIGS. 4A and 4B each illustrates a relationship among a fiber direction of a recording material, an orientation that the recording material is set, and an asperity state confirmed from a surface image.
Figure 4B:
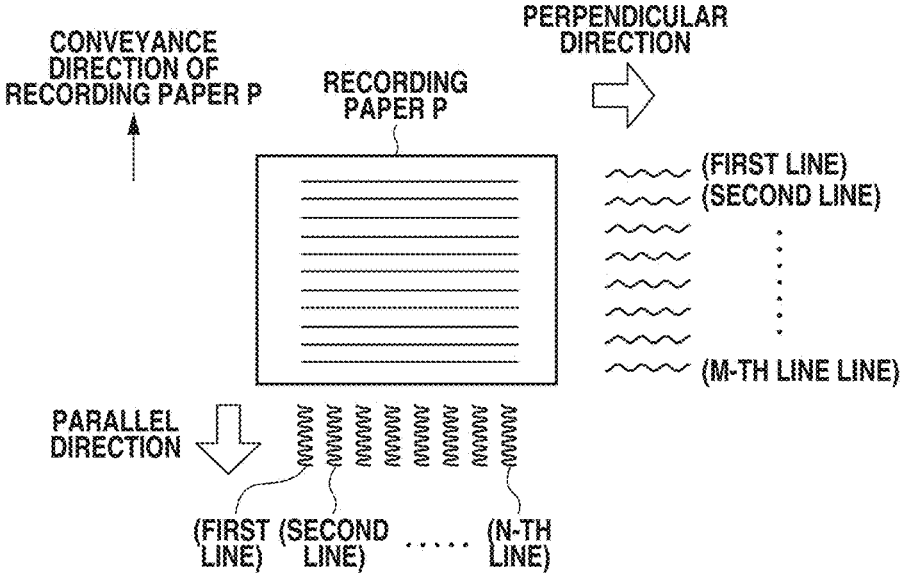

Next, influence of a fiber direction (also referred to as a grain direction) of the recording paper P on determination of the type of the recording paper P is described. FIGS. 4A and 4B illustrate the asperity states confirmed when surface images of a predetermined type of the recording paper P are captured. Portions in which lines are drawn on the recording papers P represent trough portions (shading portions) of the asperity, and portions between the lines represent peak portions of the asperity. In FIGS. 4A and 4B, the fiber direction of the recording paper P is parallel to a long side direction of the recording paper P. A recording paper P having such fiber direction is referred to as a long grain recording paper P. Further, it is not illustrated in FIGS. 4A and 4B, a recording paper P of which fiber direction is parallel to a short side direction of the recording material P is referred to as a short grain recording paper P. The fiber direction of the recording paper P is different according to a type of the recording paper P, however, when the type is the same, the fiber direction is not largely different.

FIG. 4A illustrates a state in which the recording paper P is set in the cassette 2*a* or the manual feed tray 2*b* so as to be conveyed to a direction parallel to the long side direction of the recording paper P (hereinbelow, referred to as a longitudinal conveyance). In FIG. 4A, the fiber direction of the recording paper P is parallel to the conveyance direction of the recording paper P. The surface image includes a plurality of lines (a first line to an m-th line) in a direction orthogonal to the conveyance direction of the recording paper P and a plurality of lines (a first line to an n-th line) in a direction parallel to the conveyance direction of the recording paper P. According to the present exemplary embodiment, the surface image of m*n size is obtained (m is the number of image capturing times, and n is 238 as described with reference to FIGS. 2A to 2D), and a plurality of pixels are arranged on each line. In FIG. 4A, when a variation of output values of the plurality of pixels arranged on each line in the direction orthogonal to the conveyance direction of the recording paper P is calculated, the value becomes large. This is because the peak portion and the trough portion of the recording paper P are alternately detected. On the other hand, in FIG. 4A, when a variation of output values of the plurality of pixels arranged on each line in the direction parallel to the conveyance direction of the recording paper P is calculated, the value becomes small. This is because only the peak portion or the trough portion of the recording paper P is detected.

FIG. 4B illustrates a state in which the recording paper P is set in the cassette 2*a* or the manual feed tray 2*b* so as to be conveyed to a direction parallel to the short side direction of the recording material P (hereinbelow, referred to as a lateral conveyance). In FIG. 4B, the fiber direction of the recording paper P is orthogonal to the conveyance direction of the recording paper P. In FIG. 4B, when the variation of the output values of the plurality of pixels arranged on each line in the direction orthogonal to the conveyance direction of the recording paper P is calculated, the value becomes small. This is because only the peak portion or the trough portion of the recording paper P is detected. On the other hand, in FIG. 4B, when the variation of the output values of the plurality of pixels arranged on each line in the direction parallel to the conveyance direction of the recording paper P is calculated, the value becomes large. This is because the peak portion and the trough portion of the recording paper P are alternately detected.

Figure 5A:
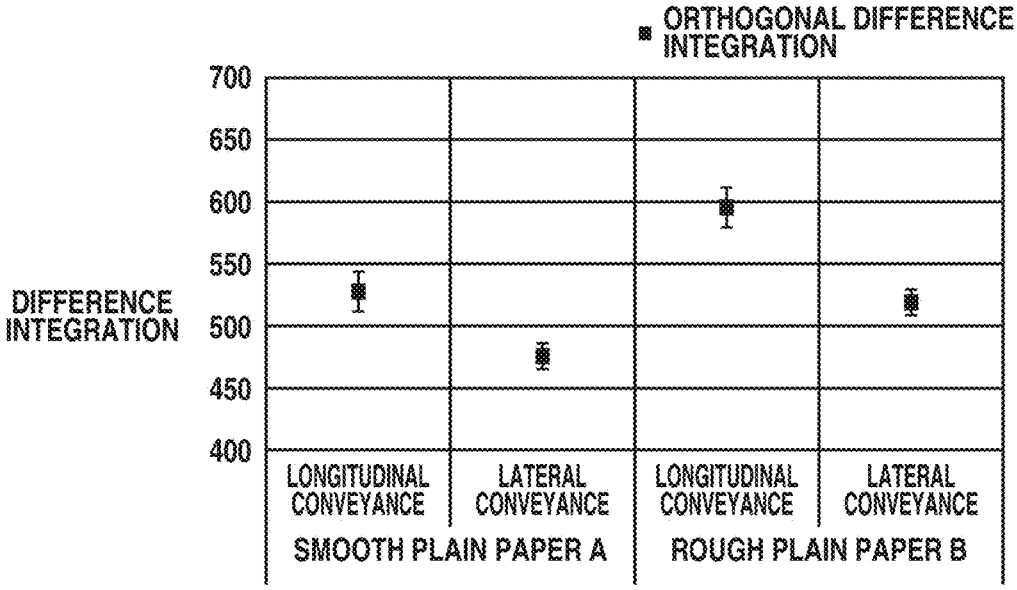
FIGS. 5A and 5B are graphs illustrating two feature quantities (parallel difference integration and orthogonal difference integration) obtained from two different types of recording materials.
Figure 5B:
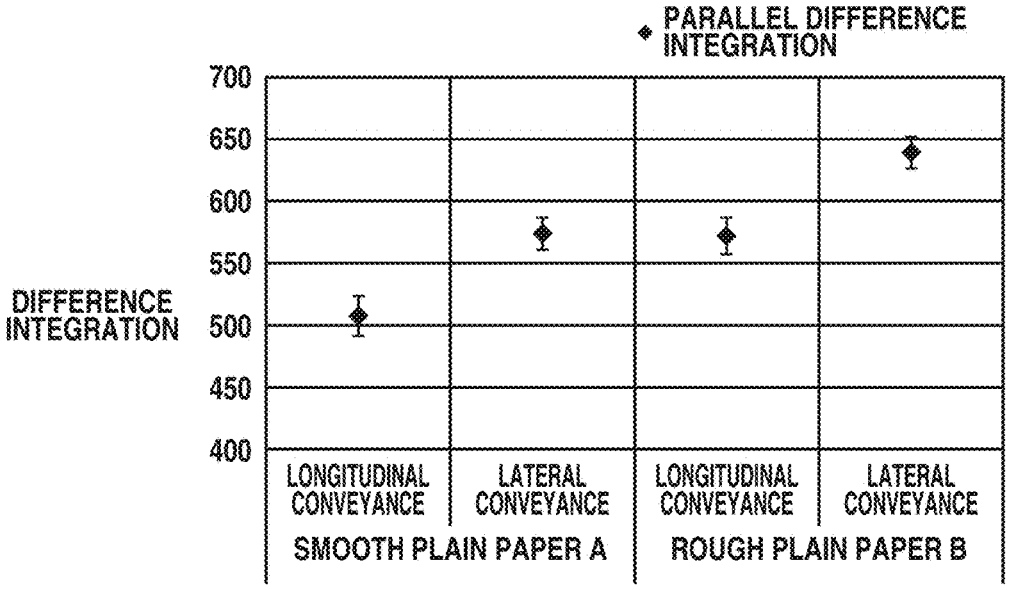

FIGS. 5A and 5B illustrate feature quantities obtained by respectively capturing surface images of two different types of recording papers P in the longitudinal conveyance and in the lateral conveyance. FIGS. 5A and 5B each illustrate results of a plain paper A having a smooth surface and a plain paper B having a rough surface. Sizes of the recording papers P are both A4 size (297 mm in long side direction*210 mm in short side direction).

FIG. 5A illustrates results obtained by calculating orthogonal difference integration as the feature quantity. The orthogonal difference integration is an integrated value of the variations of the output values of the plurality of pixels arranged on each line in the direction orthogonal to the conveyance direction of the recording paper P. A variation of output values of a plurality of pixels on a predetermined line is calculated by a method described below. For example, on the first line, a first pixel, a second pixel, a third pixel, . . . , and an n-th pixel exist which are sequentially arranged in order. The image detection unit 45 calculates an absolute value of a difference between an output value of the first pixel and an output value of the second pixel and calculates an absolute value of a difference between the output value of the second pixel and an output value of the third pixel. Further, the image detection unit 45 integrates the absolute values of these two differences. The above-described calculation is continuously performed on all pixels existing on the first line, and thus the variation of the output values of the plurality of pixels on the first line is calculated. The image detection unit 45 further performs the similar calculation on other lines (the second line to the m-th line) and integrates the variations of all lines to obtain the orthogonal difference integration. In this regard, the variation of the output values of the plurality of pixels on the predetermined line may be calculated in such a manner that a maximum value and a minimum value are obtained from the output values of the plurality of pixels arranged on the predetermined line, and an absolute value of a difference between the maximum value and the minimum value is calculated.

As illustrated in FIG. 5A, when the orthogonal difference integration is compared between the plain paper A having the smooth surface and the plain paper B having the rough surface in the case of the longitudinal conveyance, a larger value is obtained in the plain paper B than the plain paper A. Thus, a threshold value is set between these two values, and the control unit 10 can determine the plain paper A and the plain paper B. On the other hand, in the case of the lateral conveyance, values of the orthogonal difference integration become smaller in both of the plain paper A and the plain paper B due to influence of the fiber direction of the recording paper P as illustrated in FIG. 4. Therefore, values of the orthogonal difference integration in the case of the plain paper A in the longitudinal conveyance and in the case of the plain paper B in the lateral conveyance are close to each other, and in a state in which whether the longitudinal conveyance or the lateral conveyance is unclear, the control unit 10 cannot determine the plain paper A and the plain paper B.

FIG. 5B illustrates results obtained by calculating parallel difference integration as the feature quantity. The parallel difference integration is an integrated value of the variations of the output values of the plurality of pixels arranged on each line in the direction parallel to the conveyance direction of the recording paper P. The variation of the output values of the plurality of pixels on the predetermined line is calculated by a method similar to the one already described above. The image detection unit 45 calculates the variations of all lines (the first line to the n-th line) and integrates the variations to obtain the parallel difference integration.

As illustrated in FIG. 5B, the same can be applied to the parallel difference integration as the orthogonal difference integration. More specifically, when the parallel difference integration is compared between the plain paper A having the smooth surface and the plain paper B having the rough surface in the longitudinal conveyance, a larger value is obtained in the plain paper B than the plain paper A. Thus, a threshold value is set between these two values, and the control unit 10 can determine the plain paper A and the plain paper B. On the other hand, in the case of the lateral conveyance, values of the parallel difference integration become larger in both of the plain paper A and the plain paper B due to the influence of the fiber direction of the recording paper P as illustrated in FIG. 4. Therefore, values of the parallel difference integration in the case of the plain paper A in the lateral conveyance and in the case of the plain paper B in the longitudinal conveyance are close to each other, and in a state in which whether the longitudinal conveyance or the lateral conveyance is unclear, the control unit 10 cannot determine the plain paper A and the plain paper B.

Conventionally, the type of the recording paper P is determined using only the orthogonal difference integration or only the parallel difference integration as the feature quantity. Therefore, determination accuracy of the type of the recording paper P is lowered in a state in which the longitudinal conveyance and the lateral conveyance are mixed as described above, and the image quality may be deteriorated in some cases.

<Description of Determination Method of Type of Recording Material>

Figure 6:
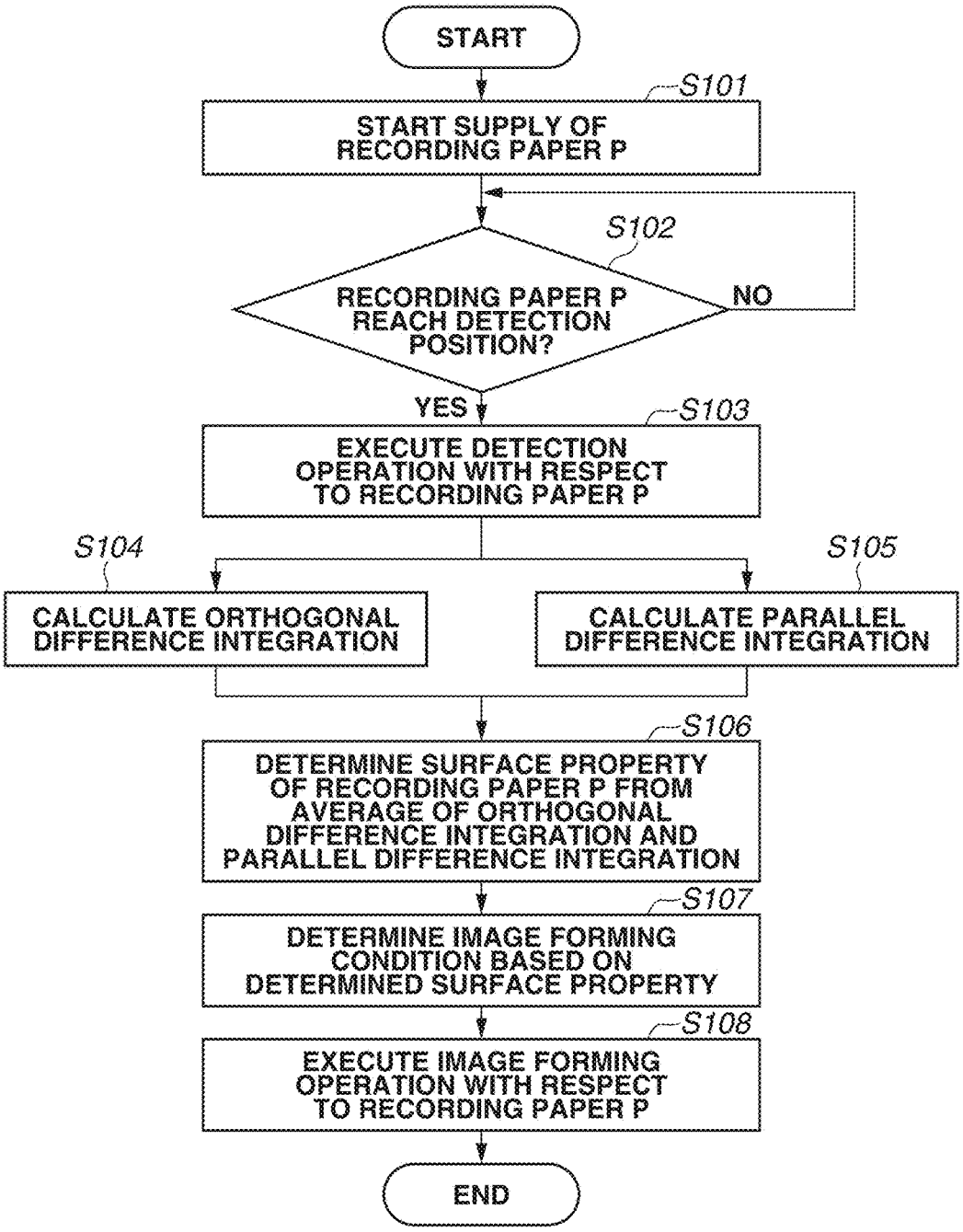
FIG. 6 is a flowchart according to the first exemplary embodiment.

A method for improving the determination accuracy of the surface property (type) of the recording paper P according to the present exemplary embodiment is described. According to the present exemplary embodiment, the surface property (type) of the recording paper P is determined using the two feature quantities (the orthogonal difference integration and the parallel difference integration) calculated along different directions. A flowchart is illustrated in FIG. 6. Control based on the flowchart in FIG. 6 is executed by the CPU 33 and the like included in the control unit 10 based on a program stored in a ROM (not illustrated).

In step S101, the control unit 10 receives a print instruction from an external device, such as a personal computer (PC) (not illustrated) and then causes the cassette 2*a* or the manual feed tray 2*b* to start feeding of the recording paper P. In step S102, the control unit 10 determines whether the recording paper P reaches the detection position of the surface property detection unit 32. If it is determined that the recording paper P reaches the detection position (YES in step S102), then in step S103, the control unit 10 instructs the illumination control unit 44 to start the detection operation. In steps S104 and S105, the image detection unit 45 calculates the orthogonal difference integration and the parallel difference integration by the above-described method from the surface image captured by the image capturing unit 32*c*. In step S106, the control unit 10 calculates an average of the obtained orthogonal difference integration and parallel difference integration and determines the surface property (type) of the recording paper P based on the obtained average value. Subsequently, in step S107, the control unit 10 determines the image forming condition of each process member including the image forming unit 50 according to the determined surface property (type) and, in step S108, forms an image on the recording paper P under the determined image forming condition.

Figure 7:
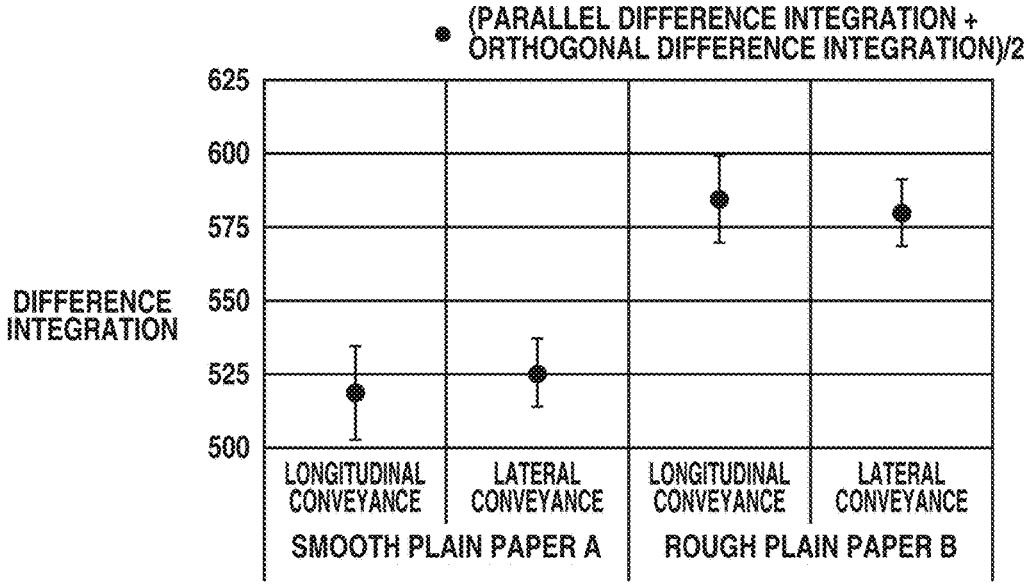
FIG. 7 is a graph illustrating averages of the two feature quantities (the parallel difference integration and the orthogonal difference integration) obtained from the two different types of recording materials.

As illustrated in the flowchart in FIG. 6, according to the present exemplary embodiment, the average of the orthogonal difference integration and the parallel difference integration is calculated. FIG. 7 illustrates averages of the orthogonal difference integration and the parallel difference integration of the two types of plain papers (the plain paper A and the plain paper B) illustrated in FIGS. 5A and 5B. Regarding both of the plain paper A and the plain paper B, approximately same values are obtained in the longitudinal conveyance and the lateral conveyance. Therefore, if it is unclear whether the conveyed recording paper P is longitudinally conveyed or laterally conveyed, the control unit 10 can determine the surface property of the recording paper P with high accuracy and determine the image forming condition. According to the present exemplary embodiment, a simple average of the orthogonal difference integration and the parallel difference integration is used, however, the determination may be performed based on other calculation results, such as a weighted average.

In the flowchart in FIG. 6, the surface property of the recording paper P is determined, and then the image forming condition according to the surface property is determined, however, the processing is not limited thereto. For example, a table as illustrated in FIG. 8 is stored in the ROM (not illustrated), and the image forming conditions such as a fixing temperature may be determined directly from the obtained feature quantity without causing the control unit 10 to determine the surface property of the recording paper P. The table in FIG. 8 illustrates averages of the orthogonal difference integration and the parallel difference integration in association with the fixing temperature to be set. For example, according to the present exemplary embodiment, when the rough plain paper B is laterally conveyed, the orthogonal difference integration will be a value between 500 to 550 and the parallel difference integration will be a value between 600 to 650. Accordingly, an averages value of the orthogonal difference integration and the parallel difference integration will be between 550 to 600, and thus the fixing temperature will be set to 180 degrees. The relationships illustrated in FIG. 8 are examples and may be appropriately set according to conditions of the detection unit 30 and the printer 1.

As described above, the two feature quantities are calculated from the surface image of the recording paper P along the different directions and combined, and thus the type of the recording paper P can be determined with high accuracy regardless of the longitudinal conveyance or the lateral conveyance. In addition, there is no need to install two light sources as the illumination units 32*a*, and the cost can be suppressed. Therefore, according to the present exemplary embodiment, the image forming apparatus can be provided which can determine a type of a recording material with high accuracy and form a high quality image while suppressing influence of a fiber direction of the recording material without increasing a cost.

According to the first exemplary embodiment, two feature quantities are calculated along different directions with respect to a single captured surface image and averaged, and thus a surface property of the recording paper P is determined with high accuracy, and the image forming condition is determined. According to a second exemplary embodiment, a method is described in which two feature quantities are calculated along different directions, and a relative fiber direction of the recording paper P is determined from the results to determine the image forming condition. The descriptions of the main parts are similar to those in the first exemplary embodiment, and only parts different from the first exemplary embodiment are described here.

First, the relative fiber direction is a fiber direction with respect to the conveyance direction of the recording paper P, and according to the present exemplary embodiment, it is not to actually determine whether a long grain recording paper P or a short grain recording paper P. In other words, when a long grain recording paper P is longitudinally conveyed and when the short grain recording paper P is laterally conveyed, the fiber direction is parallel to the conveyance direction of the recording paper P in both cases. According to the present exemplary embodiment, it is regarded as that both two recording papers P have relatively the same fiber direction.

Figure 9:
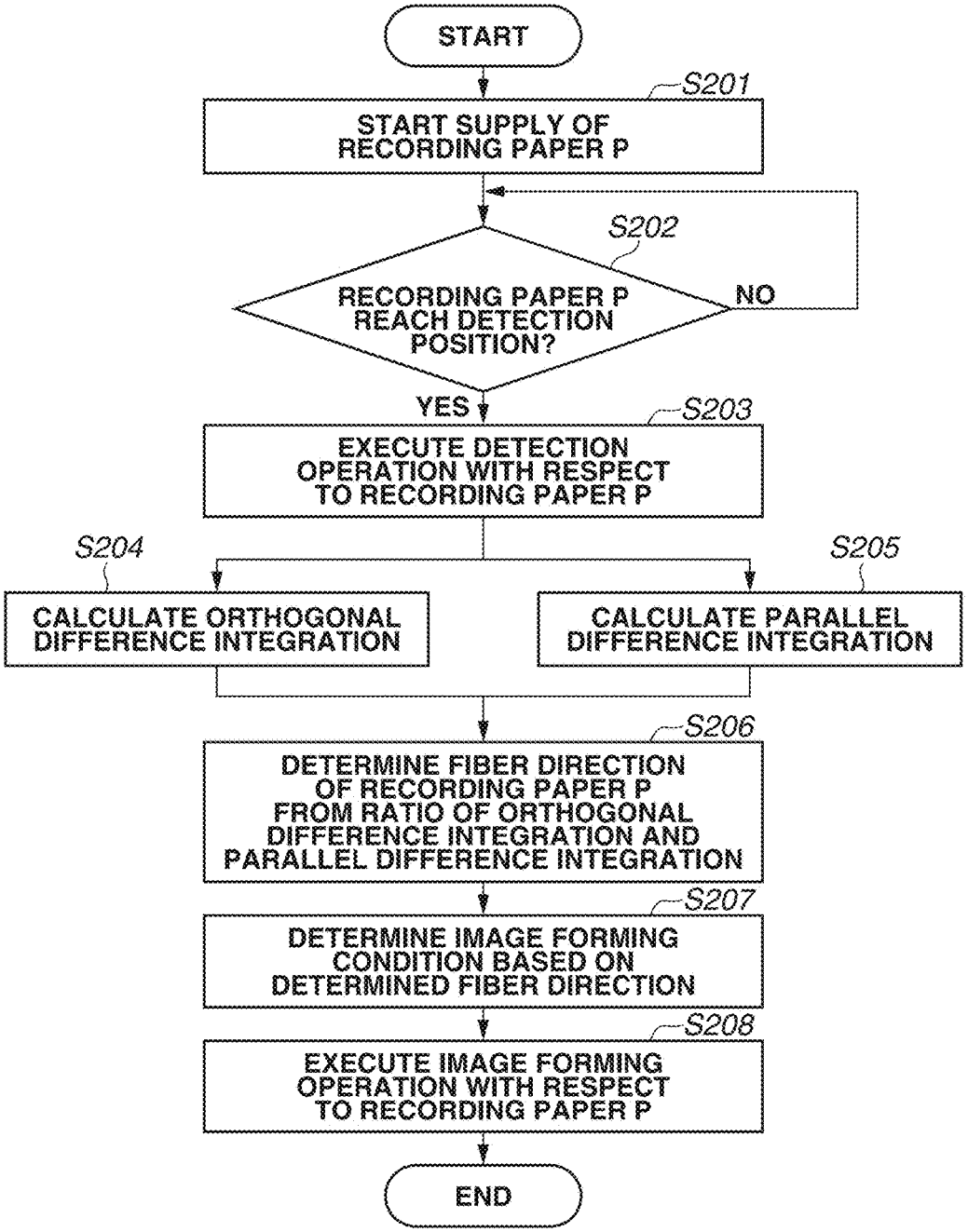
FIG. 9 is a flowchart according to the second exemplary embodiment.

A flowchart according to the present exemplary embodiment is illustrated in FIG. 9. Control based on the flowchart in FIG. 9 is executed by the CPU 33 and the like included in the control unit 10 based on a program stored in the ROM (not illustrated).

The control from step S201 to step S205 in the flowchart in FIG. 9 are the same as that from step S101 to step S105 in the flowchart in FIG. 6, so that the descriptions thereof are omitted. In step S206, the control unit 10 calculates a ratio of the obtained orthogonal difference integration and parallel difference integration and determines the relative fiber direction (type) of the recording paper P based on the obtained ratio. Subsequently, in step S207, the control unit 10 determines the image forming condition of each process member including the image forming unit 50 according to the determined fiber direction (type) and, in step S208, forms an image on the recording paper P under the determined image forming condition.

In addition, the image forming condition to be determined according to the relative fiber direction includes, for example, the fixing temperature. The relative fiber direction of the recording paper P can be roughly divided into two directions. One is a fiber direction parallel to the conveyance direction of the recording paper P, and the other is a fiber direction orthogonal to the conveyance direction of the recording paper P. It is generally known that the recording paper P having the fiber direction orthogonal to its conveyance direction easily curls compared to the recording paper P having the fiber direction parallel to its conveyance direction and easily winds around the fixing device 20. Therefore, when the image forming condition is to be determined, it is desirable that the fixing temperature of the recording paper P having the fiber direction orthogonal to its conveyance direction is set lower compared to that of the recording paper P having the fiber direction parallel to its conveyance direction so as to suppress the curl of the recording paper P.

Figure 10:
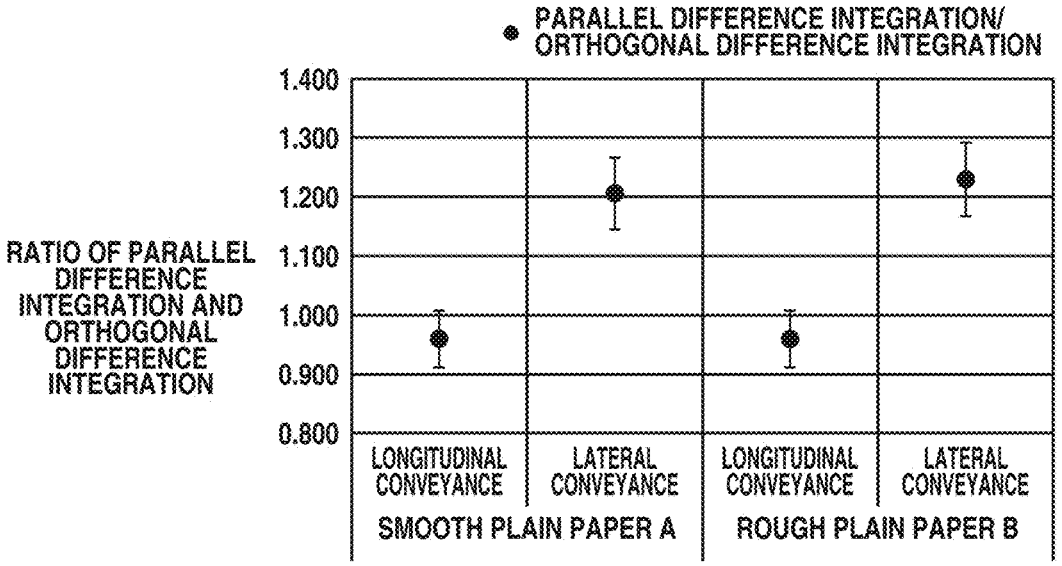
FIG. 10 is a graph illustrating ratios of the two feature quantities (the parallel difference integration and the orthogonal difference integration) obtained from the two different types of recording materials.

As illustrated in the flowchart in FIG. 9, according to the present exemplary embodiment, the ratio of the orthogonal difference integration and the parallel difference integration is calculated. FIG. 10 illustrates ratios of the orthogonal difference integration and the parallel difference integration (the parallel difference integration value/the orthogonal difference integration value) of the two types of plain papers (the plain paper A and the plain paper B) illustrated in FIGS. 5A and 5B. A state in which the ratio is small represents a state in which the orthogonal difference integration value is larger than the parallel difference integration value, so that it can be determined that the fiber direction of the recording paper P is close to the direction parallel to the conveyance direction of the recording paper P. On the other hand, a state in which the ratio is large represents a state in which the parallel difference integration value is larger than the orthogonal difference integration value, so that it can be determined that the fiber direction of the recording paper P is close to the direction orthogonal to the conveyance direction of the recording paper P.

In FIG. 10, in the case of the longitudinal conveyance, both of the plain paper A and the plain paper B indicate values from 0.9 to 1.0. Further, in the case of the lateral conveyance, both of the plain paper A and the plain paper B indicate values from 1.15 to 1.3. The results indicate that, in the case of the longitudinal conveyance, both of the plain paper A and the plain paper B have the fiber directions close to the direction parallel to the conveyance direction, and in the case of the lateral conveyance, both of the plain paper A and the plain paper B have the fiber directions close to the direction orthogonal to the conveyance direction. In other words, both of the plain paper A and the plain paper B have the fiber directions similar to the recording paper P of the predetermined type illustrated in FIGS. 4A and 4B. According to the present exemplary embodiment, the ratio of the orthogonal difference integration and the parallel difference integration is used, however, the determination may be performed based on other calculation results, such as a difference.

In the flowchart in FIG. 9, the relative fiber direction of the recording paper P is determined, and then the image forming condition according to the fiber direction is determined, however, the processing is not limited thereto. For example, a table as illustrated in FIG. 11 is stored in the ROM (not illustrated), and the image forming conditions such as a fixing temperature may be determined directly from the obtained feature quantity without causing the control unit 10 to determine the relative fiber direction of the recording paper P. The table in FIG. 11 illustrates the parallel difference integration values and the ratios of the orthogonal difference integration and the parallel difference integration in association with the fixing temperature to be set. For example, according to the present exemplary embodiment, when the rough plain paper B is laterally conveyed, the orthogonal difference integration will be a value between 500 to 550 and the parallel difference integration will be a value between 600 to 650.

Accordingly, a ratio of the orthogonal difference integration and the parallel difference integration will be from 1.15 to 1.3, and thus the fixing temperature will be set to 183 degrees. The relationships illustrated in FIG. 11 are examples and may be appropriately set according to conditions of the detection unit 30 and the printer 1.

As described above, the two feature quantities are calculated from the surface image of the recording paper P along the different directions and combined, and thus the relative fiber direction of the recording paper P with respect to the conveyance direction of the recording paper P can be determined. In addition, there is no need to install two light sources as the illumination units 32*a*, and the cost can be suppressed. Therefore, according to the present exemplary embodiment, the image forming apparatus can be provided which can determine a type of a recording material with high accuracy and form a high quality image while suppressing influence of a fiber direction of the recording material without increasing a cost.

According to the first and the second exemplary embodiments, two feature quantities are calculated along different directions with respect to a single captured surface image and averaged, and thus a surface property and a relative fiber direction of the recording paper P are determined. According to a third exemplary embodiment, a method is described in which a size and an orientation of the recording paper P are further detected to control the image forming condition more accurately. The descriptions of the main parts are similar to those in the first exemplary embodiment, and only parts different from the first exemplary embodiment are described here.

Figure 13A:
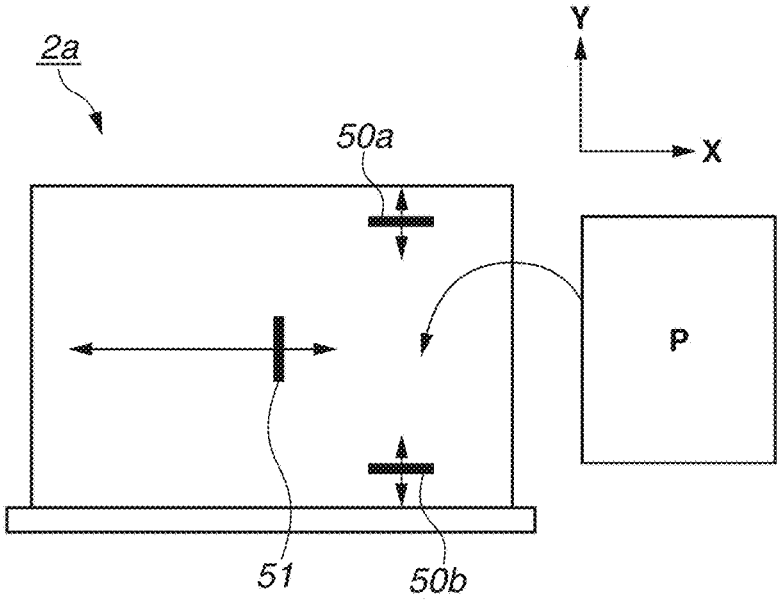
FIGS. 13A and 13B illustrate a configuration of a cassette according to the third exemplary embodiment.
Figure 13B:
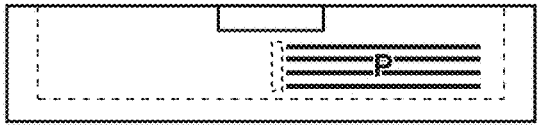

FIGS. 13A and 13B illustrate an internal configuration of the cassette 2*a* (a loading unit) according to the present exemplary embodiment. FIG. 13A is a top view illustrating a state when the recording paper P is loaded in the cassette 2*a*. FIG. 13B is a front view illustrating a state in which the recording paper P is stored in the cassette 2*a*. The cassette 2*a* includes side regulating plates 50*a* and 50*b* and a trailing edge regulating plate 51 for regulating positions of edge portions of the recording paper P. The side regulating plates 50*a* and 50*b* regulate the positions of the edge portions of the recording paper P in a direction of an arrow Y in FIG. 13A.

The trailing edge regulating plate 51 regulates the position of the edge portion of the recording paper P in a direction of an arrow X in FIG. 13A. Accordingly, a storage position of the recording paper P is fixed so as not to move in the cassette 2*a*. Further, the cassette 2*a* includes a mechanism for detecting positions of the side regulating plates 50*a* and 50*b* and the trailing edge regulating plate 51, and thus the control unit 10 can specify a size and an orientation of the recording paper P by detecting these positions.

Figure 14A:
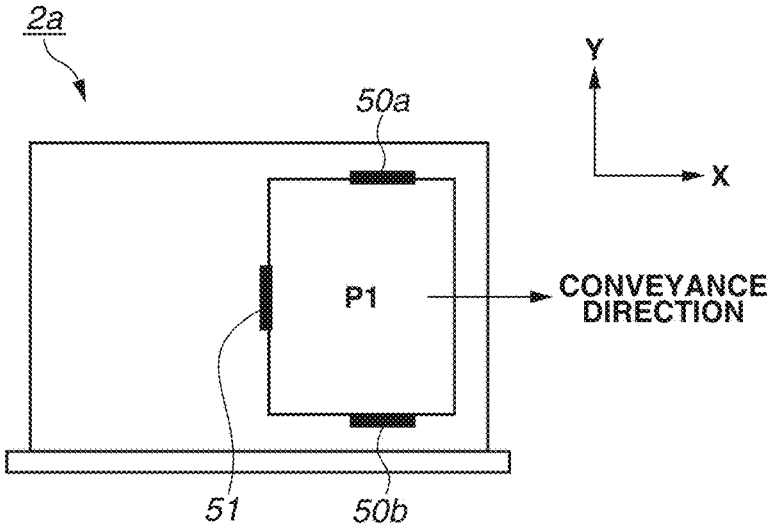
FIGS. 14A to 14C illustrate states in which a recording material is stored in the cassette according to the third exemplary embodiment.
Figure 14B:
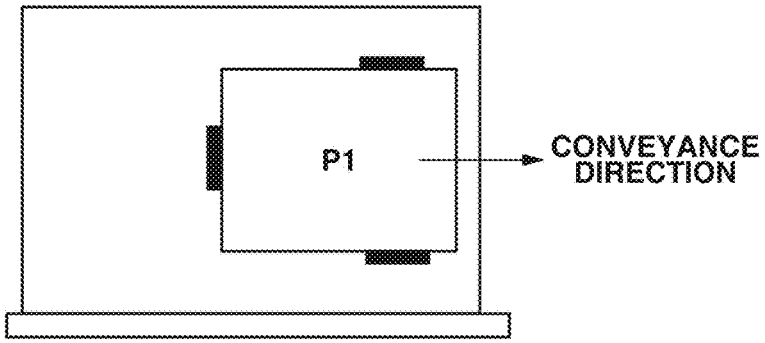
Figure 14C:
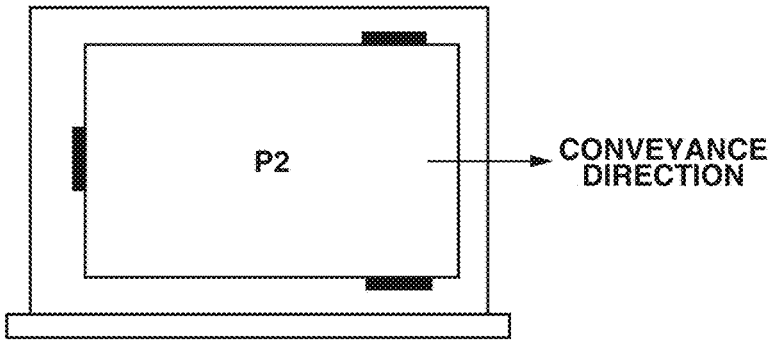

A specific example is described. FIGS. 14A to 14C are top views of the cassette 2*a* viewed from the same direction as that in FIG. 13A. FIG. 14A illustrates a state in which a small size (i.e., an A4 size) recording paper P1 is stored in the lateral conveyance state. FIG. 14B illustrates a state in which the small size recording paper P1 is stored in the longitudinal conveyance state. FIG. 14C illustrates a state in which a large size (i.e., an A3 size) recording paper P2 is stored in the longitudinal conveyance state. A storage method of the large size recording paper P2 is uniquely determined to the longitudinal conveyance, whereas a storage method of the small size recording paper P1 can be arbitrarily set to the longitudinal conveyance or the lateral conveyance.

According to the present exemplary embodiment, the control is described which is performed when the recording paper P is fed from the cassette 2*a*, however, the present invention is not limited to the above-described one. The control according to the present exemplary embodiment can be applied to a case when the recording paper P is fed from the tray 2*b*. However, it is assumed that the tray 2*b* includes the side regulating plates 50*a* and 50*b* and the trailing edge regulating plate 51.

By the above-described method, the control unit 10 can detect the size and the orientation of the recording paper P. Further, the image forming condition is controlled further more accurately using information such as the size and the orientation of the recording paper P in addition to the information pieces such as the surface property and the relative fiber direction of the recording paper P obtained from the first or the second exemplary embodiment. The method is specifically described below.

Figure 15A:
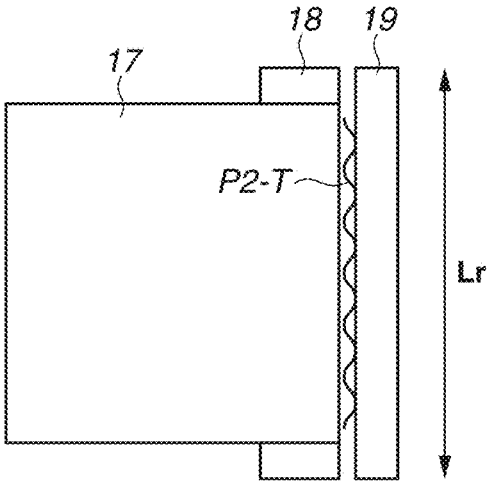
FIGS. 15A to 15C illustrate states when a long gain recording material of A3 size is longitudinally conveyed.
Figure 15B:
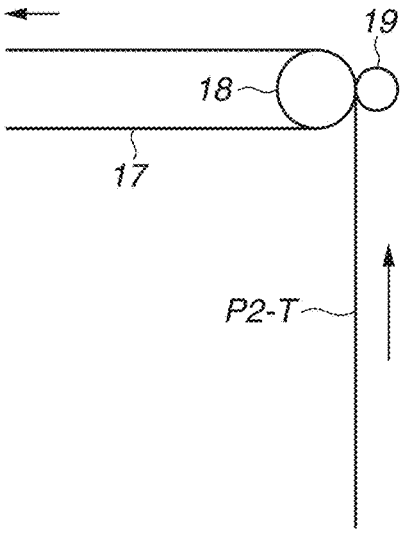
Figure 15C:
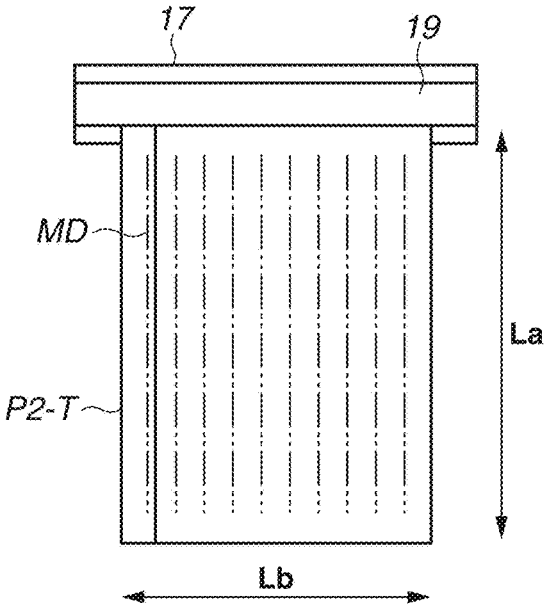
Figure 16A:
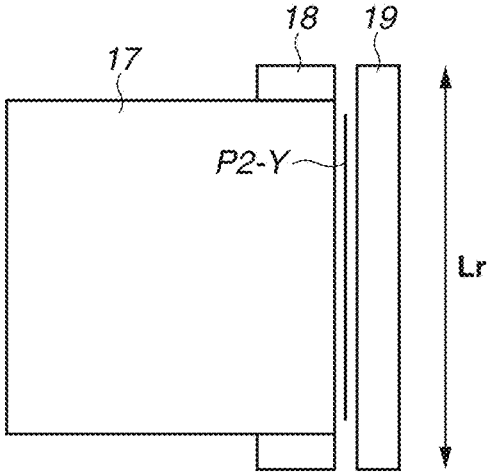
FIGS. 16A to 16C illustrate states when a short gain recording material of A3 size is longitudinally conveyed.
Figure 16B:
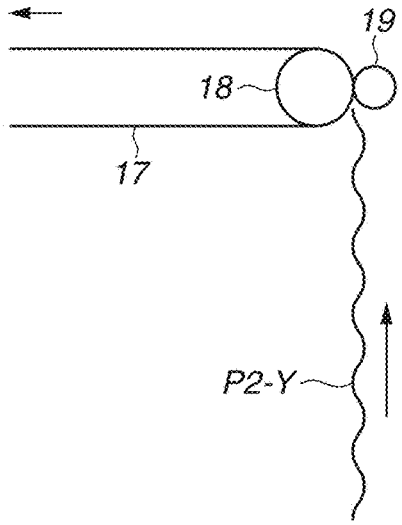
Figure 16C:
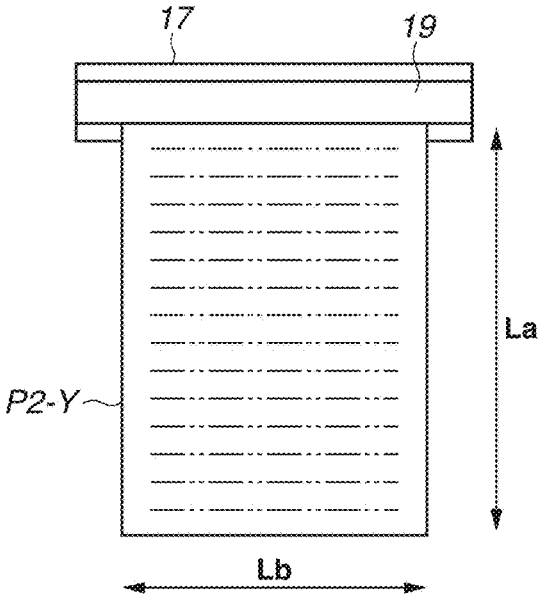

First, the recording paper P2 of A3 size (having a long side length La and a short side length Lb) is described with reference to FIGS. 15A to 15C and 16A to 16C. The recording paper P2 of A3 size is classified into a long grain recording paper P2-T and a short grain recording paper P2-Y. Thus, FIGS. 15A to 15C illustrate a case when the long grain recording paper P2-T is longitudinally conveyed, and FIGS. 16A to 16C illustrate a case when the short grain recording paper P2-Y is longitudinally conveyed. Further, as described with reference to FIGS. 14A to 14C, according to the present exemplary embodiment, the recording paper P2 of A3 size cannot be laterally conveyed and only can be longitudinally conveyed.

FIGS. 15A and 16A, FIGS. 15B and 16B, and FIGS. 15C and 16C illustrate vicinity of a transfer nip portion respectively viewed from three directions, namely top, front, and side surfaces in an enlarged state. Here, the top, front, and side surfaces are with reference to FIG. 1. That is, the "viewed from the top surface" indicates that the vicinity is viewed from the top direction in FIG. 1. The "viewed from the front surface" indicates that the vicinity is viewed from the front in FIG. 1. The "viewed from the side surface" indicates that the vicinity is viewed from the right direction in FIG. 1. In FIGS. 15C and 16C, long dashed double-short dashed lines MD are drawn to facilitate understanding of a state of the grain direction of the recording paper P2. Further, in FIGS. 15A and 16A and in FIGS. 15B and 16B, surface states of the recording paper P2 having the grain direction are expressed as a wave form in a deformed state. Further, in FIGS. 15B and 16B, a moving direction of the intermediate transfer belt 17 and the conveyance direction of the recording paper P2 are each indicated by an arrow. Further, in FIGS. 15A and 16A, the secondary transfer roller 19 has a length Lr in the width direction, and in FIGS. 15C and 16C, the recording paper P2 has the long side length La and the short side length Lb.

A method is described for setting a transfer current value of the secondary transfer roller 19 with respect to the recording paper P2 of A3 size. In FIG. 15A, the recording paper P2-T has a wavy surface due to the influence of the grain direction, and thus an area coming into contact with the secondary transfer roller 19 is small. On the other hand, in FIG. 16A, the grain direction of the recording paper P2-Y is parallel to the surface of the secondary transfer roller 19, and thus an area coming into contact with the secondary transfer roller 19 is large. Therefore, an electric resistance value is larger in the case illustrated in FIG. 15A than the case illustrated in FIG. 16A. Accordingly, in the case illustrated in FIG. 15A, the transfer current value is set larger compared to that in the case illustrated in FIG. 16A.

Figure 17A:
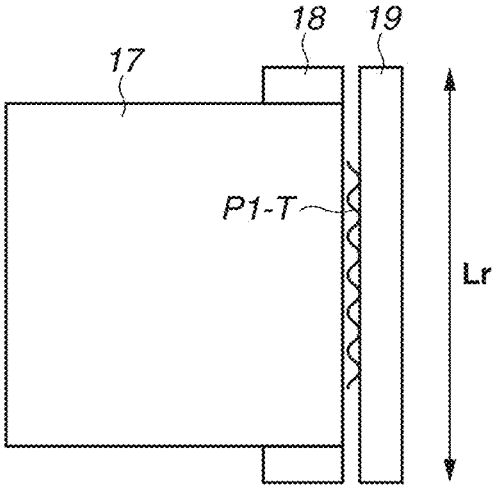
FIGS. 17A to 17C illustrate states when a long gain recording material of A4 size is longitudinally conveyed.
Figure 17B:
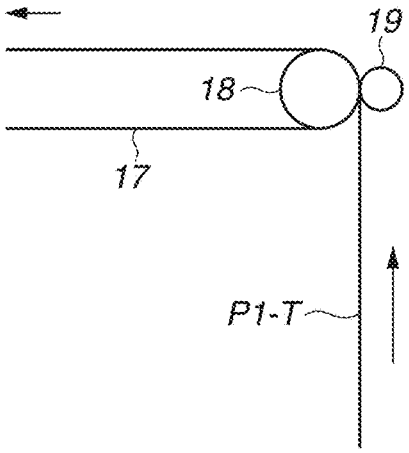
Figure 17C:
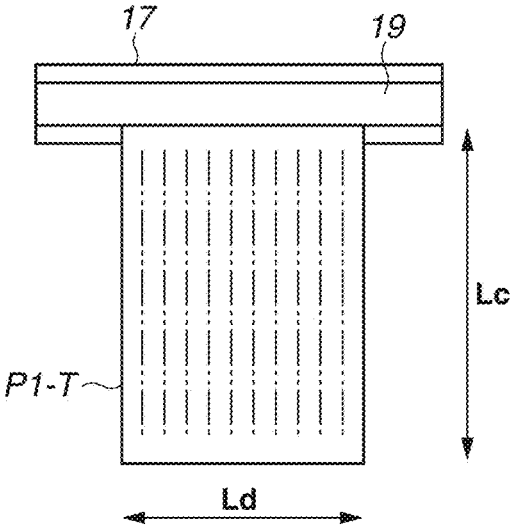
Figure 18A:
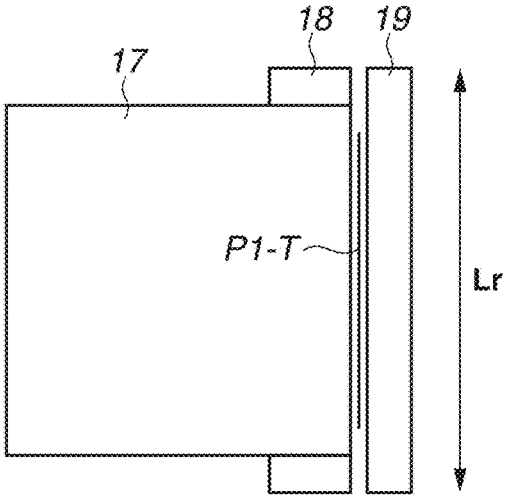
FIGS. 18A to 18C illustrate states when a long gain recording material of A4 size is laterally conveyed.
Figure 18B:
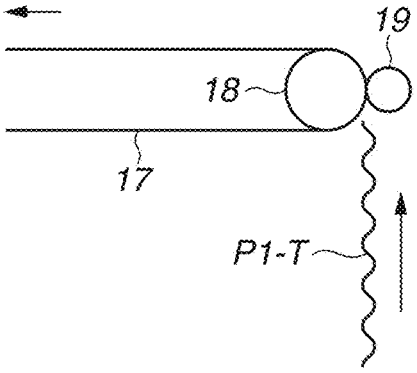
Figure 18C:
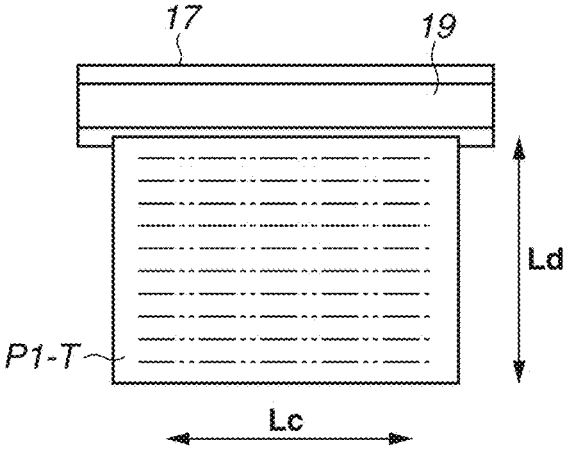
Figure 19A:
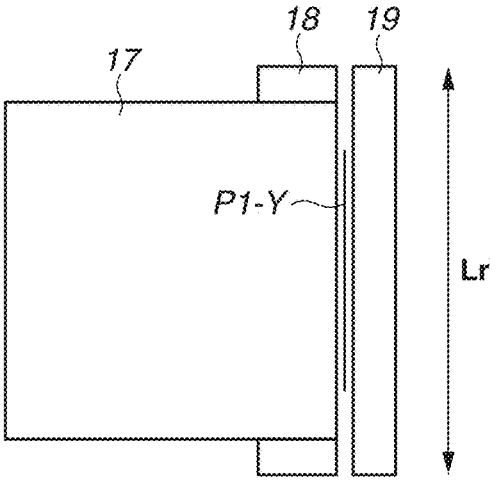
FIGS. 19A to 19C illustrate states when a short gain recording material of A4 size is longitudinally conveyed.
Figure 19B:
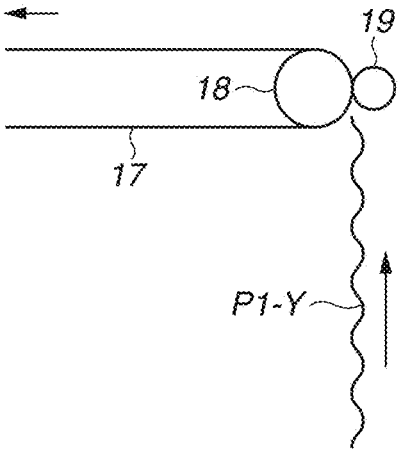
Figure 19C:
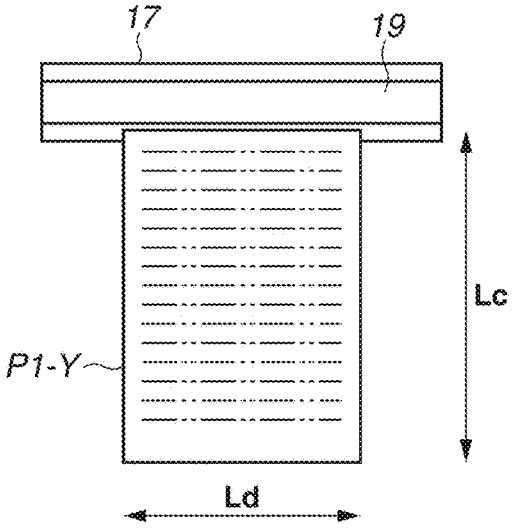
Figure 20A:
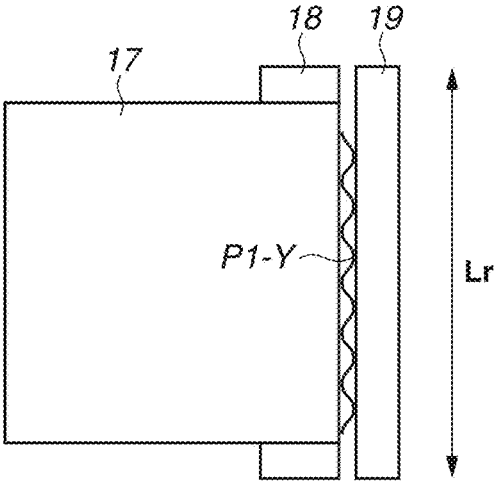
FIGS. 20A to 20C illustrate states when a short gain recording material of A4 size is laterally conveyed.
Figure 20B:
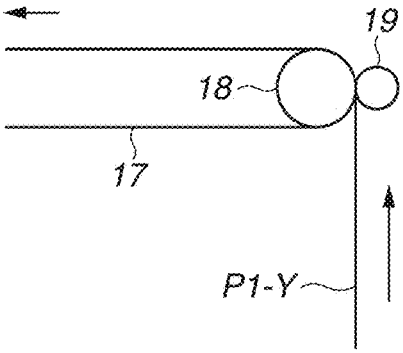
Figure 20C:
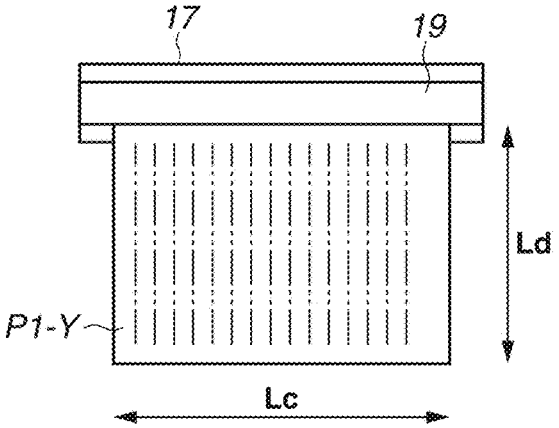

Next, the recording paper P1 of A4 size (having a long side length Lc and a short side length Ld) is described with reference to FIGS. 17A to 17C to FIGS. 20A to 20C. The recording paper P1 of A4 size is classified into a long grain recording paper P1-T and a short grain recording paper P1-Y. As described with reference to FIGS. 14A to 14C, according to the present exemplary embodiment, the recording paper P1 of A4 size can be longitudinally conveyed and laterally conveyed. FIGS. 17A to 17C illustrate a case when the long grain recording paper P1-T is longitudinally conveyed, and FIGS. 18A to 18C illustrate a case when the long grain recording paper P1-T is laterally conveyed. Further, FIGS. 19A to 19C illustrate a case when the short grain recording paper P1-Y is longitudinally conveyed, and FIGS. 20A to 20C illustrate a case when the short grain recording paper P1-Y is laterally conveyed.

FIGS. 17A to 17C and FIGS. 18A to 18C illustrate the vicinity of the transfer nip portions respectively viewed from three different directions in an enlarged state as with the case in FIGS. 15A to 15C. A difference from FIGS. 15A to 15C is a size of the recording paper P1, and in FIGS. 17C and 18C, the recording paper P1 has the long side length Lc and the short side length Ld.

The method is described for setting a transfer current value of the secondary transfer roller 19 with respect to the long grain recording paper P1-T of A4 size. In FIG. 17A, there is an area in which the recording paper P1-T does not intervene in the transfer nip portion which corresponds to a difference between the length Lr of the secondary transfer roller 19 in the width direction and the short side length Ld of the recording paper P1-T. The areas exist on both sides of the recording paper P1-T at a length of (Lr−Ld)/2. In the area, the transfer current flows more easily compared to an area in which the recording paper P1-T intervenes. Thus, in the case illustrated in FIG. 17A, the transfer current value is set larger compared to that in the case illustrated in FIG. 15A in order to transfer the toner image to the recording paper P1-T. Further, when the long grain recording paper P1-T of A4 size is laterally conveyed, the state of the transfer nip portion viewed from a direction in FIG. 18A is not different from that in FIG. 16A. Thus, in the case illustrated in FIG. 18A, the transfer current value may be set to the same as that in the case illustrated in the FIG. 16A.

FIGS. 19A to 19C and FIGS. 20A to 20C illustrate the vicinity of the transfer nip portions respectively viewed from three different directions in an enlarged state as with the case in FIGS. 15A to 15C. A difference from FIGS. 15A to 15C is a size of the recording paper P1, and in FIGS. 19C and 20C, the recording paper P1has the long side length Lc and the short side length Ld.

The method is described for setting a transfer current value of the secondary transfer roller 19 with respect to the short grain recording paper P1-Y of A4 size. In FIG. 19A, there is an area in which the recording paper P1-Y does not intervene in the transfer nip portion which corresponds to a difference between the length Lr of the secondary transfer roller 19 in the width direction and the short side length Ld of the recording paper P1-Y. The areas exist on both sides of the recording paper P1-Y at a length of (Lr−Ld)/2. In the area, the transfer current flows more easily compared to an area in which the recording paper P1-Y intervenes. Thus, in the case illustrated in FIG. 19A, the transfer current value is set larger compared to that in the case illustrated in FIG. 16A in order to transfer the toner image to the recording paper P1-Y. Further, when the short grain recording paper P1-Y of A4 size is laterally conveyed, the state of the transfer nip portion viewed from a direction in FIG. 20A is not different from that in FIG. 15A. Thus, in the case illustrated in FIG. 20A, the transfer current value may be set to the same as that in the case illustrated in the FIG. 15A.

The image forming condition is not limited to the transfer current value of the secondary transfer roller 19. A method is described for setting the fixing temperature of the fixing device 20 according to the present exemplary embodiment.

In the case of the long grain recording paper P2-T of A3 size, the fixing temperature is set to a lower side than the fixing temperature conventionally set, and thus generation of curl can be avoided which has a center axis of curvature of the curl in an axis direction parallel to the conveyance direction. It is important to avoid conveyance of the recording paper P2-T having a curl state with a U-shape (or an inverted U-shape) with respect to the conveyance direction since it easily causes conveyance failure in a conveyance process after fixing. Further, in the case of the short grain recording paper P2-Y of A3 size, the fixing temperature of the leading edge side of the recording paper P2-Y is set to a lower side, and thus generation of curl can be avoided which has a center axis of curvature of the curl in an axis direction orthogonal to the conveyance direction. In addition, winding around a roller unit included in the fixing device 20 and the like can be prevented. It is often the case that a white margin portion is set to the leading edge portion of the recording paper P2-Y in the conveyance direction, and actually no image is formed therein in a document used in offices and the like. Since toner for image forming is not transferred to the recording paper P2-Y in the leading edge portion including the margin and the like, and necessity to apply fixing heat to melt the toner is low. Therefore, the fixing temperature can be set sufficiently lower on the leading edge side, and a state can be avoided in which the recording paper is hardly separated from a fixing roller unit because the toner is likely to transfer and attach to the fixing roller side when being melted and fixed to a paper surface. When the recording paper P2-Y is not normally separated from the roller unit, the recording paper P2-Y winds around the roller unit, and there is a possibility that the image forming process is interrupted. However, if the recording paper P2-Y can be conveyed in a state in which the leading edge portion is separated from the roller unit, the recording paper P2-Y can be continuously conveyed toward the trailing edge portion and can be prevented from winding around the roller unit.

When the long grain recording paper P1-T of A4 size is longitudinally conveyed, the fixing temperature is controlled in a main scanning direction, and thus temperature rise can be prevented at the edge portion in the width direction, and generation of curl can be avoided which has a center of curvature of the curl in an axis direction parallel to the conveyance direction. Further, when the long grain recording paper P1-T of A4 size is laterally conveyed, the recording paper can be prevented from winding around the roller unit included in the fixing device 20 and the like by setting the fixing temperature of the leading edge side of the recording paper to a lower side.

When the recording paper P1 exists in an entire roller width at the time of paper conveyance as in the case that the recording paper P1 of A4 size is laterally conveyed in a nip portion constituted of a roller pair included in the fixing device for an A3 size apparatus, the fixing heat is uniformly transmitted to the recording paper P1, and no thermal problem is caused. However, when the recording paper P1 of A4 size is longitudinally conveyed, there is an area in which the recording paper P1 does not exist in the edge portion in the main scanning direction of the fixing device for the A3 size apparatus, and thus a temperature may remarkably increase at the roller edge portion side of the fixing device 20 in some cases. It is referred to as the edge portion temperature rise.

When the short grain recording paper P1-Y of A4 size is longitudinally conveyed, the fixing temperature is controlled in the main scanning direction to prevent the edge portion temperature rise in the width direction, and the fixing temperature of the leading edge side of the recording paper P1-Y is set to the lower side. Accordingly, winding around the roller unit included in the fixing device 20 and the like can be prevented. Further, when the short grain recording paper P1-Y of A4 size is laterally conveyed, the fixing temperature is set to a lower side than the fixing temperature conventionally set, and thus generation of curl can be avoided which has a center of curvature of the curl in an axis direction parallel to the conveyance direction.

Accordingly, the present exemplary embodiment has an effect described below in addition to that of the first exemplary embodiment. In other words, the image forming apparatus can be provided which can determine a type of a recording material more accurately by detecting a size and an orientation of the recording material and form a high quality image.

Figure 12A:
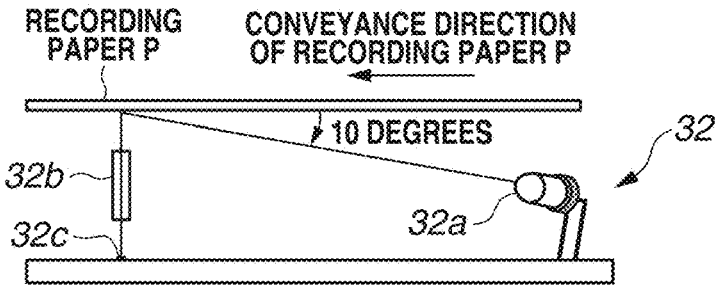
FIGS. 12A to 12C illustrate a configuration of another surface property detection unit according to the first to third exemplary embodiments.
Figure 12B:
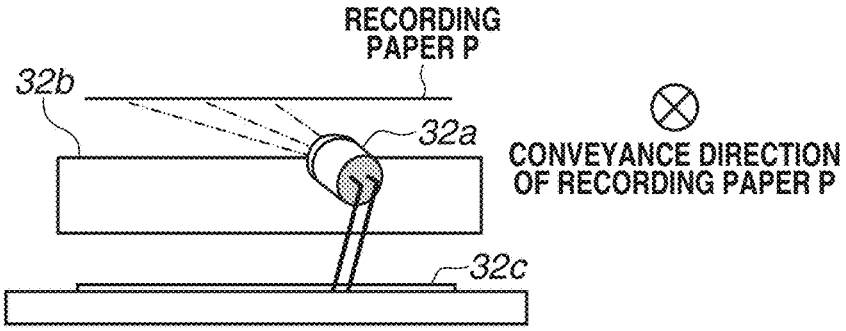
Figure 12C:
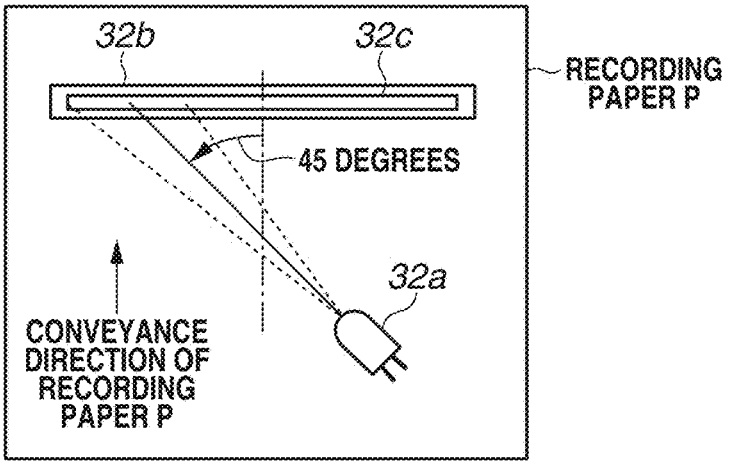

According to the above-described first to third exemplary embodiments, a direction of the light emitted from the illumination unit 32*a* is parallel to the conveyance direction of the recording paper P as illustrated in FIGS. 2A to 2D. However, the present invention is not limited to the above-described configuration. For example, the surface property detection unit 32 may include a configuration as illustrated in FIGS. 12A to 12C. FIGS. 12A to 12C respectively correspond to FIGS. 2A to 2C and illustrate the surface property detection unit 32 viewed from the three different directions. As illustrated in FIGS. 12B and 12C, the illumination unit 32*a* emits light from an oblique direction at a 45-degree angle with respect to the conveyance direction of the recording paper P. A difference of the orthogonal difference integration and the parallel difference integration obtained from the configuration illustrated in FIGS. 12A to 12C is smaller than a difference of the orthogonal difference integration and the parallel difference integration obtained from the configuration illustrated in FIGS. 2A to 2D. However, a similar effect can be obtained to that according to the above-described exemplary embodiments.

Further, according to the above-described first to third exemplary embodiments, the image detection unit 45 calculates two feature quantities, namely the orthogonal difference integration and the parallel difference integration. However, the present invention is not limited to the above-described configuration. Not only two but also three or more feature quantities may be calculated, and a type of the recording paper P may be determined by combining the feature quantities to determine the image forming conditions. Further, two feature quantities may not be calculated along directions orthogonal to each other as with the orthogonal difference integration and the parallel difference integration. Two feature quantities may be calculated along at least different (intersecting) directions.

Further, the above-described first or second exemplary embodiment is especially useful in a configuration which does not include an edge portion regulating plate for detecting an orientation and a size of the recording paper P stored in the cassette 2*a* and the manual feed tray 2*b* and the like. According to the above-described exemplary embodiments, if the configuration cannot detect whether the longitudinal conveyance or the lateral conveyance in advance, the type of the recording paper P can be determined with high accuracy, and the image forming condition can be determined.

Further, according to the above-described first to third exemplary embodiments, the detection unit 30 is fixedly installed in the printer 1, however, the detection unit 30 may have a configuration detachably attachable to the printer 1. If the detection unit 30 has a detachably attachable configuration, for example, when the detection unit 30 breaks down, a user can easily change the detection unit. Alternatively, the detection unit 30 may simply have a configuration which can be additionally attached to the printer 1.

Further, according to the above-described first to third exemplary embodiments, the detection unit 30 and the control unit 10 may be unified as a recording material determination apparatus and have a configuration detachably attachable to the printer 1. If the detection unit 30 and the control unit 10 are unified and exchangeable as described above, when a function of the detection unit 30 is updated and added, a user can easily exchange to a sensor having the new function. Alternatively, the detection unit 30 and the control unit 10 may be simply unified and have a configuration which can be additionally attached to the printer 1.

Further, according to the above-described first to third exemplary embodiments, a laser beam printer is exemplified, however, an image forming apparatus to which the present invention is applied is not limited to the laser beam printer and may be a printer using other printing methods, such as an ink jet printer, or a copying machine.

An image forming apparatus to which a fourth exemplary embodiment can be applied is schematically described. According to the present exemplary embodiment, an electrophotographic method laser beam printer 100 (hereinbelow, referred to as the printer 100) is described as the image forming apparatus.

<Description of Image Forming Apparatus>

Figure 21:
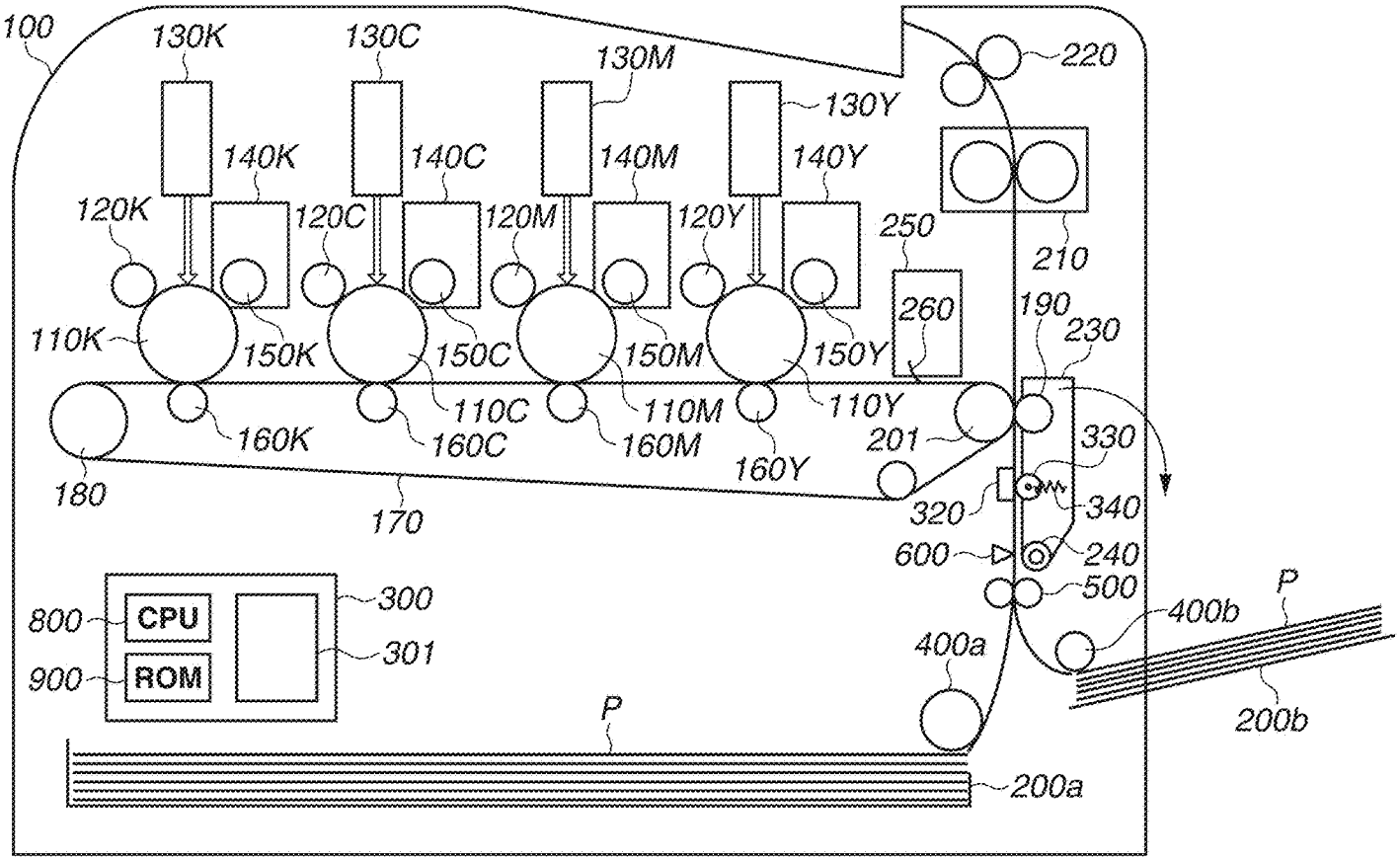
FIG. 21 is a cross-sectional view of an image forming apparatus according to fourth and fifth exemplary embodiments.

FIG. 21 is a cross-sectional view of the printer 100 which adopts an intermediate transfer belt 170 (hereinbelow, referred to as the belt 170) and includes an image forming unit for forming an image on a recording paper P (a recording material). The printer 100 is a tandem type color printer which can form a color image on the recording paper P by superimposing toners as developers of four colors namely yellow (Y), magenta (M), cyan (C), and black (K). A cassette 200*a* which stores the recording paper P and a manual feed tray 200*b* which stores the recording paper P are examples of the storage units. The printer 100 includes a sheet feed roller 400*a* for feeding the recording paper P from the cassette 200*a*, a sheet feed roller 400*b* for feeding the recording paper P from the tray 200*b*, and a pair of conveyance rollers 500 for conveying the recording paper P fed by the sheet feed roller 400*a* or 400*b*. These rollers are examples of conveyance units for conveying the recording paper P. A registration sensor 600 as an example of a detection unit for detecting a leading edge and a trailing edge of the recording paper P is installed near the roller pair 500. The registration sensor 600 includes a flag and a photo-interrupter, which are not illustrated. The flag is operated by the conveyed recording paper P, and thus an on/off signal is output from the photo-interrupter.

Photosensitive drums 110 (110Y, 110M, 110C, and 110K) bear toners of respective colors. Charging rollers 120 (120Y, 120M, 120C, and 120K) uniformly charge the photosensitive drums 110 to predetermined potential. Laser scanners 130 (130Y, 130M, 130C, and 130K) correspond to the respective colors. Process cartridges 140 (140Y, 140M, 140C, and 140K) respectively store toners for visualizing electrostatic latent images formed by the scanners 130 on the drums 110. Developing rollers 150 (150Y, 150M, 150C, and 150K) respectively supply the toners stored in the cartridges 140 to the drums 110. Primary transfer rollers 160 (160Y, 160M, 160C, and 160K) primarily transfer the images formed on the drums 110 to the belt 170. The belt 170 is driven and rotated by a driving roller 180. A secondary transfer roller 190 transfers an image formed on the belt 170 to the recording paper P, and a counter roller 201 faces to the secondary transfer roller 190. The secondary transfer roller 190 and the counter roller 201 forms a nip portion, and the image formed on the belt 170 is transferred to the recording paper P when the recording paper P is nipped and conveyed in the nip portion. The secondary transfer roller 190 and the counter roller 201 are examples of the transfer unit for secondarily transferring the image to the recording paper P. A fixing device 210 is an example of a fixing unit which melts and fixes the toner image secondarily transferred to the recording paper P while conveying the recording paper P. A pair of discharge rollers 220 discharges the recording paper P subjected to the fixing by the fixing device 210 to the outside of the printer 100. In addition, a cleaning device 250 is disposed on the belt 170 which scrapes off a toner left on the belt 170 by a cleaning member such as cleaning blade 260 installed therein to prepare for the next image forming.

The printer 100 includes a surface property detection unit 320 for detecting a surface property of the recording paper P as a property of the recording paper P to determine a type of the recording paper P. Although it is described in detail below, the surface property detection unit 320 illuminates the recording paper P with light and captures the light reflected on the recording paper P as a surface image to detect the surface property of the recording paper P. In FIG. 21, the surface property detection unit 320 is disposed on an upstream side of the conveyance direction of the recording paper P than the nip portion formed by the secondary transfer roller 190 and the counter roller 201. A secondary transfer unit 230 holds a pressing roller 330 and a pressing spring 340 for pressing the recording paper P to the surface property detection unit 320 and the secondary transfer roller 190. The secondary transfer unit 230 is movable with a rotation axis 240 as a supporting point to a direction of an arrow in the drawing, and accordingly, if the recording paper P being conveyed is jammed in the vicinity of the secondary transfer unit 230, a user can easily remove the jammed recording paper P.

A control unit 300 includes a CPU 80 and comprehensively controls image forming operations in the printer 100. The control unit 300 includes a ROM 90 in which stores various programs and various constants related to signal processing for performing image forming. The control unit 300 further includes a sensor control unit 301 which calculates a feature quantity representing the surface property of the recording paper P from the image captured by the surface property detection unit 320. The sensor control unit 301 determines the type of the recording paper P based on the calculated feature quantity. The control unit 300 determines a print mode according to the type of the recording paper P determined by the sensor control unit 301 and controls various image forming conditions.

For example, when a thickness is the same, a resistance value of the recording paper P referred to as a gloss paper having a smooth surface is lower compared to that of the recording paper P referred to as a rough paper having a rough surface. Thus, the gloss paper requires a greater transfer current and a higher transfer voltage for transferring a toner image compared to the rough paper. Further, the gloss paper requires a lower fixing temperature and a shorter fixing time for fixing the toner image compared to the rough paper, so that it is necessary to change fixing conditions, such as the fixing temperature and a conveyance speed of the recording paper P. As described above, the control unit 300 controls the various image forming conditions according to the type of the recording paper P and thus can improve a quality of an image formed on the recording paper P.

The image forming conditions may further include, for example, the conveyance speed of the recording paper P, voltage values applied to the primary transfer rollers 160 and the secondary transfer roller 190, a temperature when the fixing device 210 fixes an image on the recording paper P, and the like. The control unit 300 may control rotation speeds of the primary transfer rollers 160 and the secondary transfer roller 190 when transferring an image as the image forming conditions. Further, the control unit 300 may control a rotation speed of a fixing roller included in the fixing device 210 when fixing an image as the image forming condition. Furthermore, the control unit 300 may directly control the image forming condition from a value of the feature quantity calculated by the sensor control unit 301 without determining the type of the recording paper P.

<Description of Surface Property Detection Unit>

Figure 22:
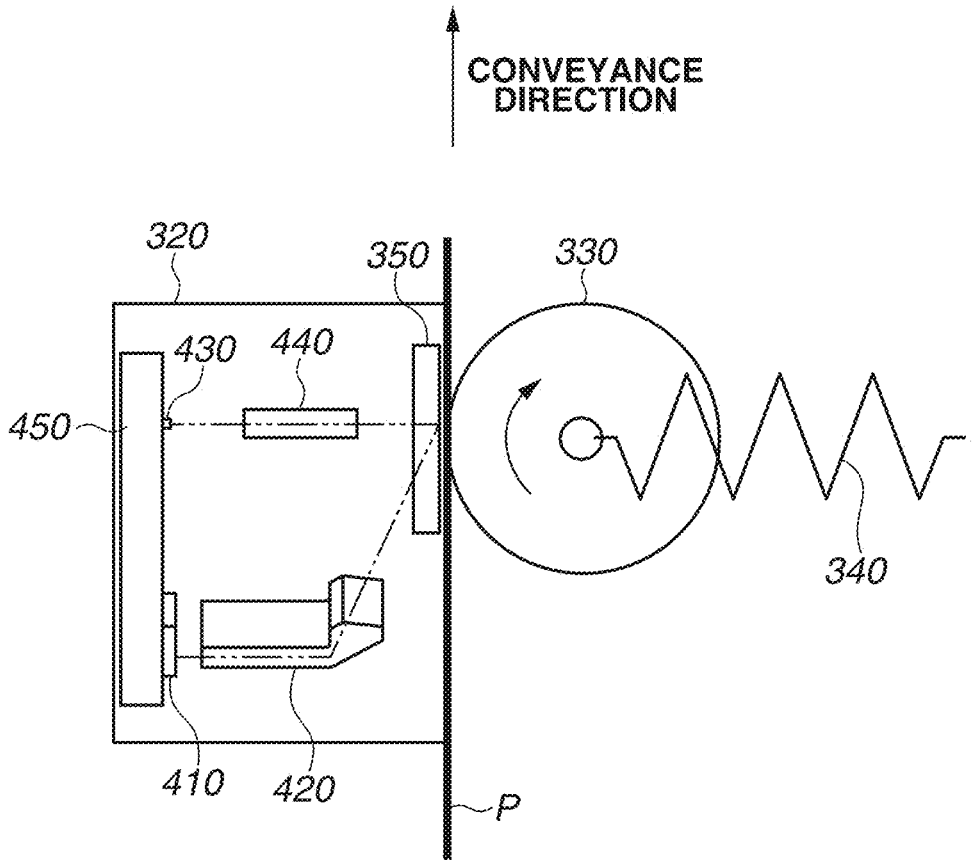
FIG. 22 is an enlarged cross-sectional view of a surface property detection unit and peripheral members according to the fourth and fifth exemplary embodiments.
Figure 23A:
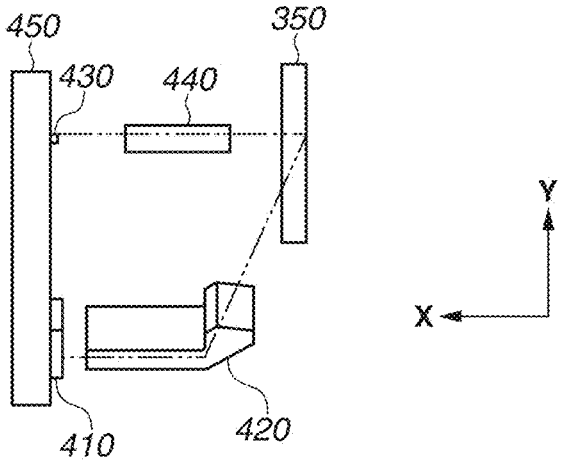
FIGS. 23A to 23C are three-view drawings illustrating a configuration of the surface property detection unit according to the fourth and fifth exemplary embodiments.
Figure 23B:
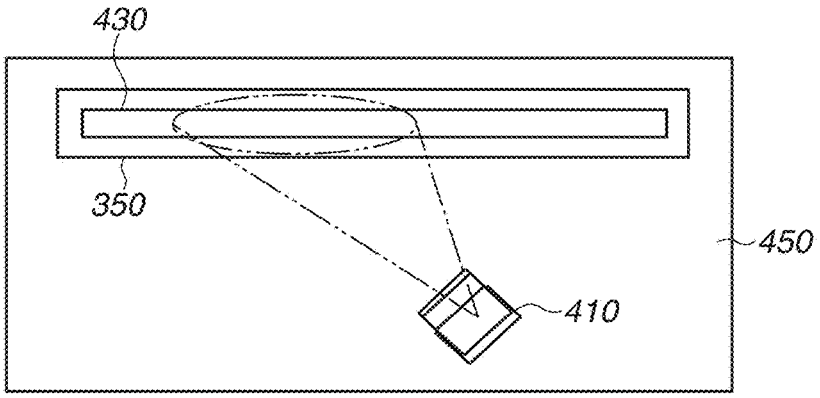
Figure 23C:
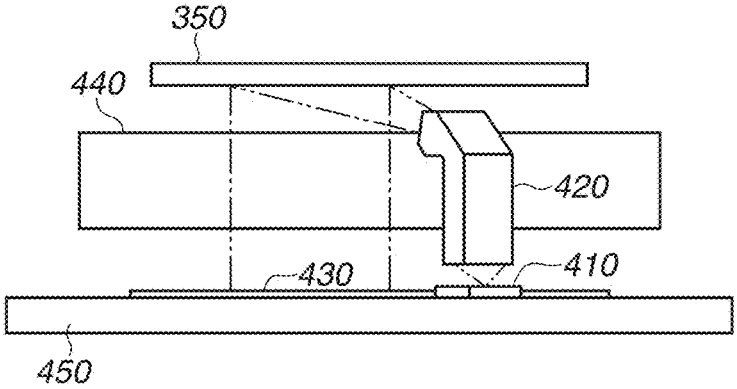
Figure 24:
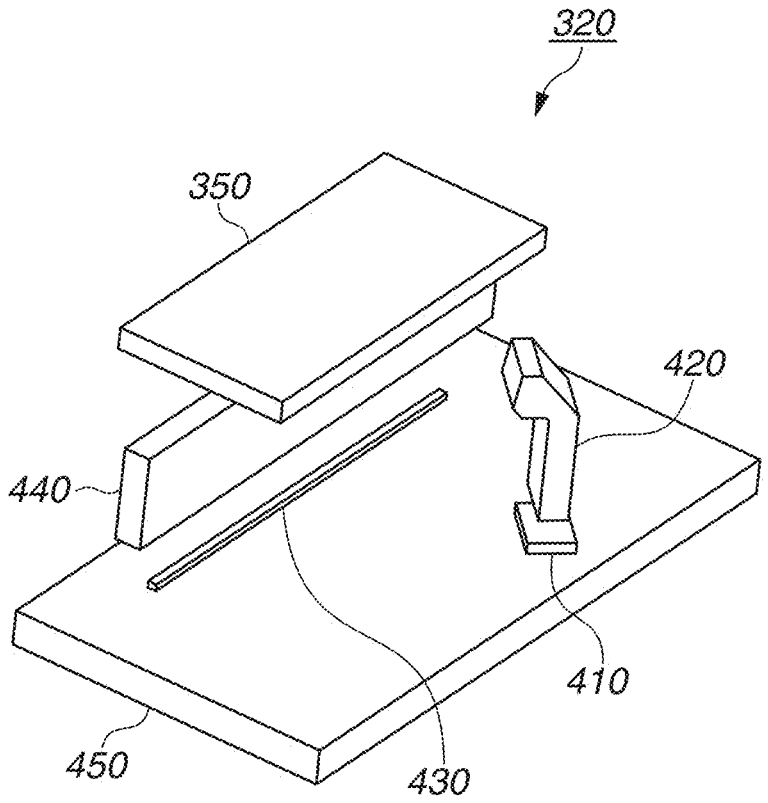
FIG. 24 is a perspective view illustrating the configuration of the surface property detection unit according to the fourth and fifth exemplary embodiments.

Next, the configuration of the surface property detection unit 320 is described in detail below with reference to FIGS. 22 to 24. FIG. 22 is an enlarged cross-sectional view of the surface property detection unit 320 and peripheral members extracted from FIG. 21. FIGS. 23A to 23C is a three-view drawing of the surface property detection unit 320 from which a housing unit is removed. FIG. 23A is a cross-sectional view of the surface property detection unit 320 viewed from the same direction in FIG. 22, FIG. 23B illustrates the surface property detection unit 320 viewed along a direction of an arrow X in FIG. 23A, and FIG. 23C illustrates the surface property detection unit 320 viewed along a direction of an arrow Y in FIG. 23A. FIG. 24 is a perspective view of the surface property detection unit 320 without the housing unit. As illustrated in FIGS. 22 to 24, the surface property detection unit 320 includes a light-emitting diode (LED) light source 410 (the illumination unit), a polarizer 420, an image sensor 430 (an image capturing unit), a rod lens 440, a sensor substrate 450, and a light-transmitting member 350. The LED light source 410 disposed on the sensor substrate 450 illuminates the recording paper P with light. The polarizer 420 deflects the light from the LED light source 410 so that the light is incident on the surface of the recording paper P at an oblique angle (10 to 15 degrees). The light from the polarizer 420 passes through the light-transmitting member 350 and illuminates the surface of the recording paper P. The light reflected on the surface of the recording paper P and passing through the light-transmitting member 350 is condensed onto the image sensor 430 by the rod lens 440. The image sensor 430 in a line shape extending to the width direction of the recording paper P is disposed on the sensor substrate 450 and captures the condensed light as a surface image including a plurality of pixels.

Further, in FIG. 22, the pressing roller 330 is urged by the pressing spring 340 to press the recording paper P against the light-transmitting member 350. The pressing roller 330 rotates to a direction of an arrow in FIG. 22 along with the conveyance of the recording paper P. Accordingly, flapping of the recording paper P in the conveyance can be reduced, and the image sensor 430 can capture the surface image without blurring. Further, according to the present exemplary embodiment, the image sensor 430 on the line extending to the width direction of the recording paper P is used as illustrated in FIGS. 23A to 23C and FIG. 24. In the image sensor 430, 238 pieces of the light receiving elements are arranged side by side in the width direction of the recording paper P. One light receiving element corresponds to one pixel. Thus, when the image sensor 430 captures an image once, an image of 238 pixels can be obtained. In addition, a series of image capturing operations is repeated while conveying the recording paper P, and captured linear images are connected in the conveyance direction of the recording paper P, so that the surface property detection unit 320 can obtain a surface image having a size of (the number of image capturing times*238 pixels).

<Description of Relationship Between Detection Result of Surface Property Detection Unit and Fiber Direction of Recording Material>

Figure 25:
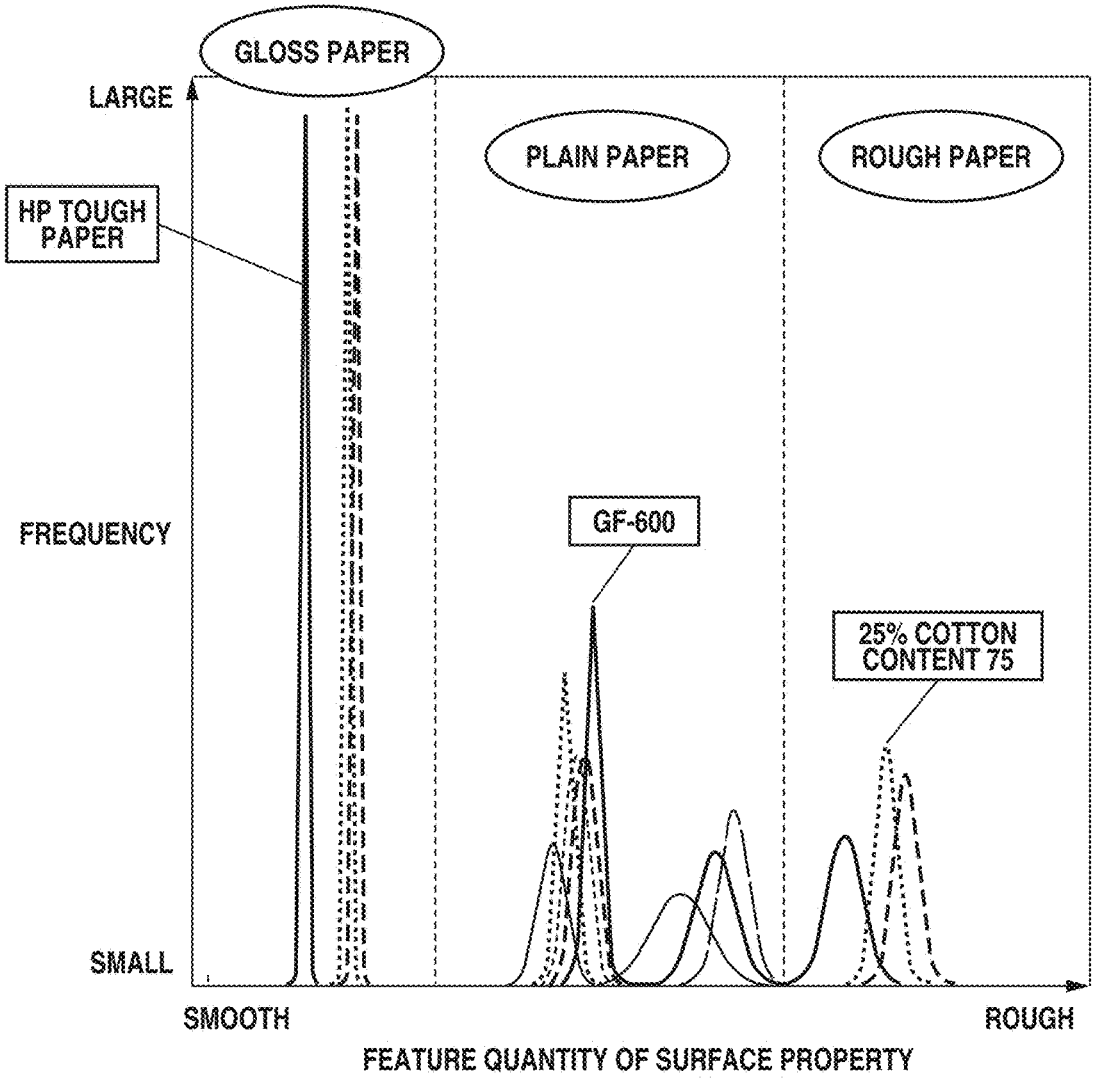
FIG. 25 is a graph illustrating detection results of a plurality of brands of recording papers by the surface property detection unit.

Next, results obtained by actually detecting the surface property of the recording paper P using the surface property detection unit 320 are illustrated in FIG. 25. FIG. 25 illustrates results which were obtained in such a manner that a plurality of brands was respectively selected from different types of the recording papers P and surface properties thereof were detected by the surface property detection unit 320. The type of the recording paper P is classification, such as a rough paper, a plain paper, and a gloss paper. The brand is a smaller classification than the type and includes such as 25% Cotton Content 75 (the rough paper), GF-600 (the plain paper), HP Tough Paper (the gloss paper).

FIG. 25 illustrates frequency distribution in which the abscissa indicates feature quantities calculated by the sensor control unit 301 and the ordinate indicates frequencies. The sensor control unit 301 can calculate the feature quantity by, for example, a method described below. First, the sensor control unit 301 selects a maximum output value (hereinbelow, referred to as the maximum value) and a minimum output value (hereinbelow, referred to as the minimum value) from output values of a plurality of pixels in one line of a surface image captured by the image sensor 430. Subsequently, the sensor control unit 301 calculates a difference between the selected maximum value and minimum value and integrates the difference values for the number of measured lines. According to the present exemplary embodiment, the sensor control unit 301 calculates the feature quantity along a line parallel to the width direction of the recording paper P. In the case of the recording paper P having a rough surface (asperity is deep) as with the rough paper, an image includes a high ratio of shadow due to the illuminated light, and in the case of the recording paper P having a smooth surface (asperity is shallow) as with the gloss paper, an image includes less shadow. Therefore, the feature quantity calculated by the above-described method becomes larger as the surface of the recording paper P is rougher and becomes smaller as the surface thereof is smoother.

A plurality of normal distribution curves illustrated in FIG. 25 corresponds to each brand. An average value and a variance value of the normal distribution respectively indicate an average value and a variance value of the feature quantity obtained by detecting a plurality of the recording papers of the corresponding brand. For example, the gloss paper has a small value in the feature quantity indicated in the abscissa, and its distribution has a narrow foot and sharp curve in any brands, so that variation of the feature quantity is also small. On the other hand, the rough paper has large asperity on its surface, the feature quantity indicated in the abscissa has a large value in any brands. In addition, the distribution curve has a wide foot, so that variation of the feature quantity is also large.

Figure 26:
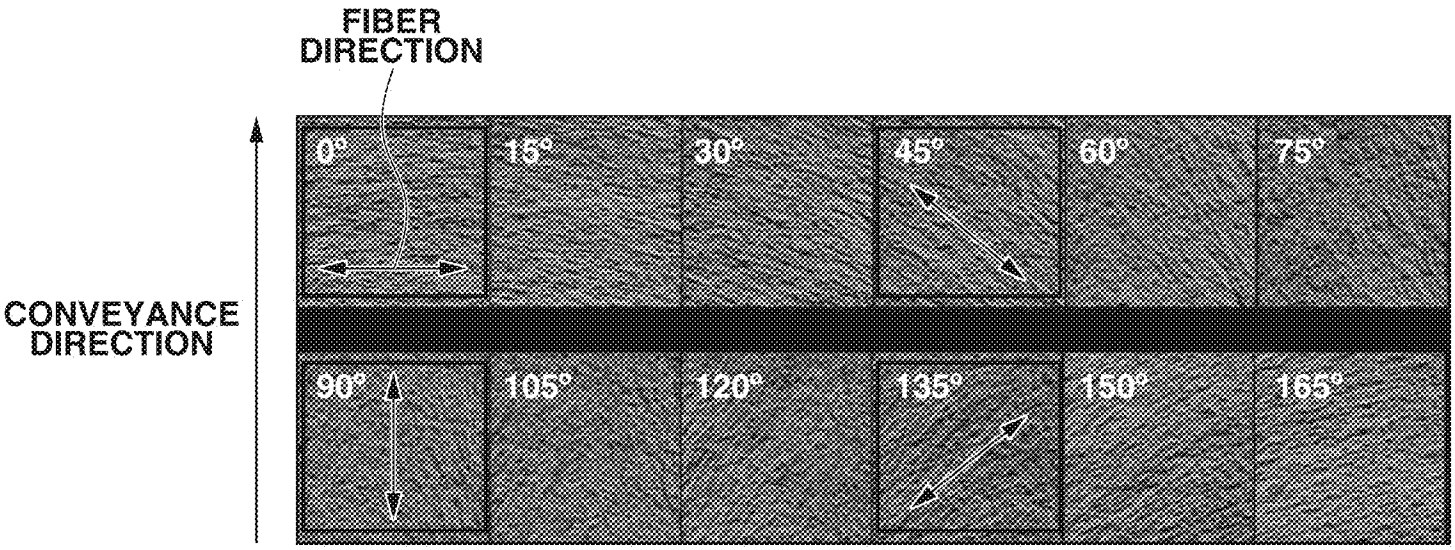
FIG. 26 illustrates relationships of fiber directions of a recording paper and images obtained by the surface property detection unit regarding the recording paper of the same brand.

Next, a relationship between the detection result by the surface property detection unit 320 and the fiber direction (also referred to as the grain direction) of the recording paper P is described with reference to FIGS. 26 and 27. FIG. 26 illustrates the surface images of the recording paper P captured by the surface property detection unit 320 by rotating the recording paper P by 15 degrees. In FIG. 26, the fiber direction of the recording paper P is in a state orthogonal to the conveyance direction of the recording paper P is regarded as a reference state at 0 degree. From the images illustrated in FIG. 26, it can be confirmed that when the orientation of the recording paper P is rotated to a clockwise direction by 45 degrees from the reference state, the fiber direction of the recording paper P is also changed to a direction rotated by 45 degrees compared to the reference state. Further, it can be confirmed that when the orientation of the recording paper P is rotated to the clockwise direction by 90 degrees from the reference state, the fiber direction of the recording paper P is also changed to an orthogonal direction compared to the reference state. Furthermore, it can be confirmed that when the orientation of the recording paper P is rotated to the clockwise direction by 135 degrees from the reference state, the fiber direction of the recording paper P is also changed to a direction rotated by 135 degrees compared to the reference state. When the orientation of the recording paper P is rotated by 45 degrees and when the orientation of the recording paper P is rotated by 135 degrees, the fiber directions of the recording paper P are orthogonal to each other.

Figure 27:
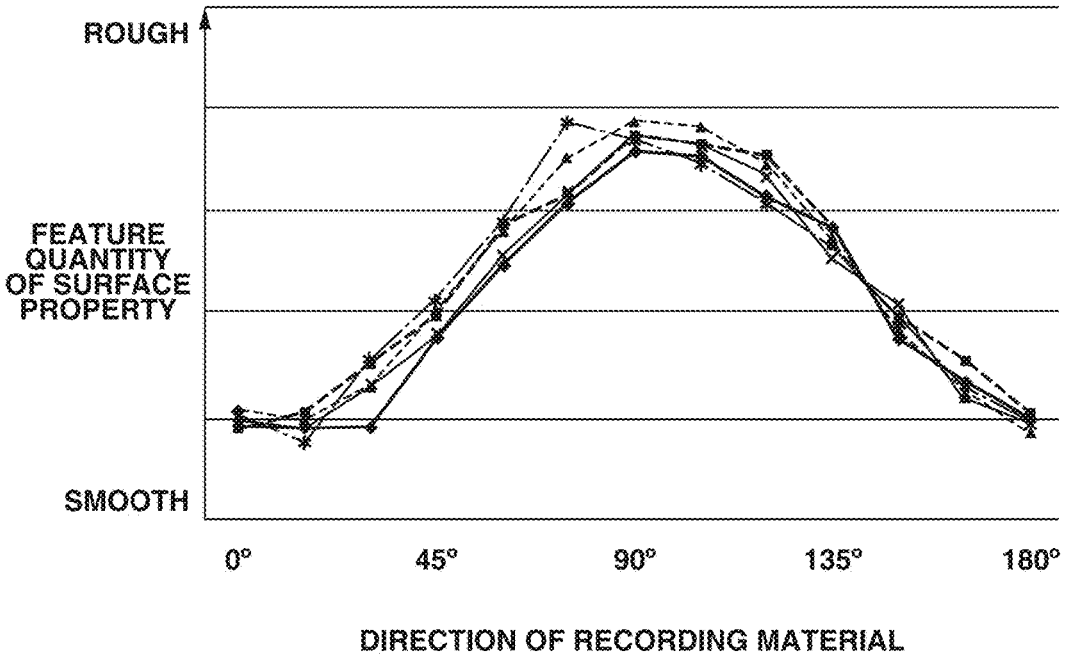
FIG. 27 is a graph illustrating relationships of fiber directions of recording papers and detection results by the surface property detection unit regarding the recording papers of the same brand.

FIG. 27 is a graph obtained by plotting the feature quantities indicating the surface property of the recording paper P obtained from these images. In FIG. 27, the feature quantities are plotted which are obtained by selecting five sheets of the recording paper P of the same brand. As can be seen from the graph in FIG. 27, the feature quantities are the smallest in a state of 0 degrees and a state of 180 degrees and are the largest in a state of 90 degrees. Thus, it can be confirmed that the feature quantity is greatly changed by the orientation of the recording paper P, namely the fiber direction of the recording paper P.

Figure 28:
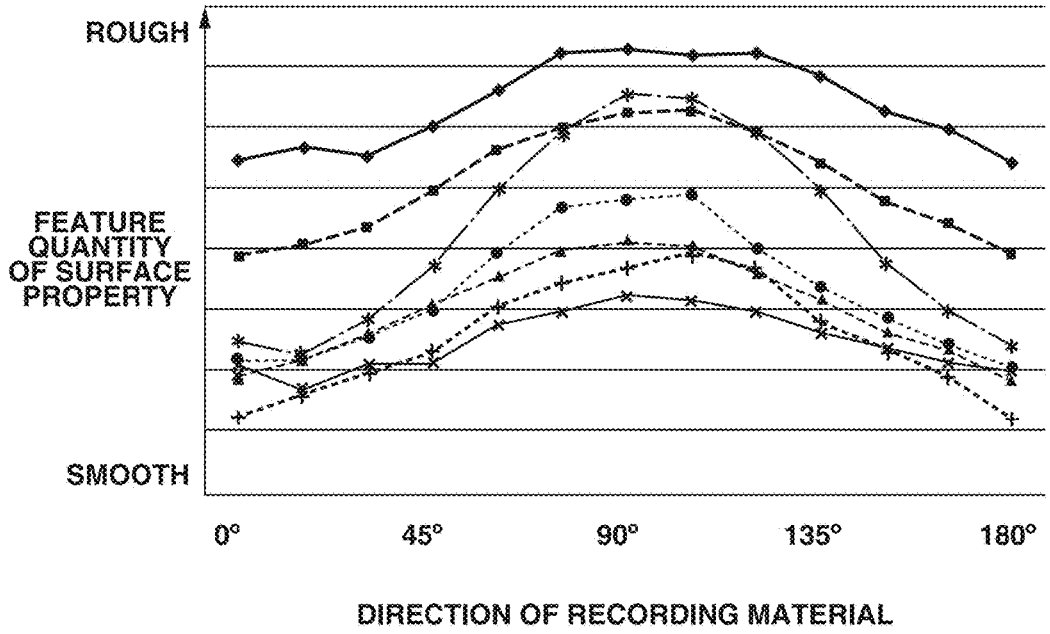
FIG. 28 is a graph illustrating relationships of fiber directions of recording papers and detection results by the surface property detection unit regarding the recording papers of a plurality of brands.

FIG. 28 illustrates results obtained by using the similar method and further increasing types and brands of the recording papers P. In FIG. 28, each curve represents the feature quantity obtained from the recording paper P of the different brand. The curve positioned higher in an ordinate direction of the graph in FIG. 28 indicates that the surface is rougher such as the rough paper. Further, the curve positioned lower in the ordinate direction of the graph in FIG. 28 indicates that the surface is smoother such the gloss paper. From the recording papers P of any brands, it can be understood that the feature quantity is changed by the orientation of the recording paper P, namely the fiber direction of the recording paper P.

Accordingly, there is a strong correlationship between the detection result by the surface property detection unit 320 and the fiber direction of the recording paper P, and even the same recording paper P, a different feature quantity may be obtained by the influence of the fiber direction. Thus, there is a possibility that the determination accuracy of the type of the recording paper P is lowered, and the image quality is deteriorated.

It is known that the fiber direction of the recording paper P is fixed according to the brand of the recording paper P. For example, a brand which has a fiber direction parallel to a long side direction of the recording paper P is referred to as a long grain recording paper P, and a brand which has a fiber direction parallel to a short side direction of the recording paper P is referred to as a short grain recording paper P. Thus, when the orientation of the recording paper P stored in the storage unit is specified (the longitudinal conveyance or the lateral conveyance), the fiber direction is uniquely determined in each brand. The longitudinal conveyance is a state in which the recording paper P is loaded so that the long side direction of the recording paper P coincides with the conveyance direction of the recording paper P, and the lateral conveyance is a state in which the recording paper P is loaded so that the short side direction of the recording paper P coincides with the conveyance direction of the recording paper P. Thus, when an image of a long grain brand of the recording paper P in the longitudinal conveyance state is captured by the surface property detection unit 320, the fiber direction of the recording paper P can be confirmed in the direction parallel to the conveyance direction of the recording paper P in the captured image. On the other hand, when an image of a short grain brand of the recording paper P in the longitudinal conveyance state is captured by the surface property detection unit 320, the fiber direction of the recording paper P can be confirmed in the direction orthogonal to the conveyance direction of the recording paper P in the captured image.

As described above, when the orientation of the recording paper P is specified, the fiber direction is uniquely determined in each brand, so that what kind of feature quantity is obtained by the surface property detection unit 320 is also uniquely determined in each brand. Therefore, the type of the recording paper P can be determined with high accuracy, and the image forming condition can be improved.

<Description of Determination Method of Type of Recording Material>

A method for determining a type of the recording paper P according to the present exemplary embodiment is described. As already described above, according to the present exemplary embodiment, the orientation of the recording paper P stored in the storage unit is specified so as to suppress the influence of the fiber direction of the recording paper P. The method is described below. The cassette 200*a* is described here as the storage unit. An internal configuration of the cassette 200*a* according to the present exemplary embodiment is the same as the internal configuration of the cassette 2*a* illustrated in FIG. 9. In other words, the cassette 200*a* includes the side regulating plates 50*a* and 50*b* and the trailing edge regulating plate 51 for regulating positions of edge portions of the recording paper P. Further, the cassette 200*a* includes the mechanism for detecting positions of the side regulating plates 50*a* and 50*b* and the trailing edge regulating plate 51, and thus the control unit 300 can specify a size and an orientation of the recording paper P by detecting these positions.

Figure 29A:
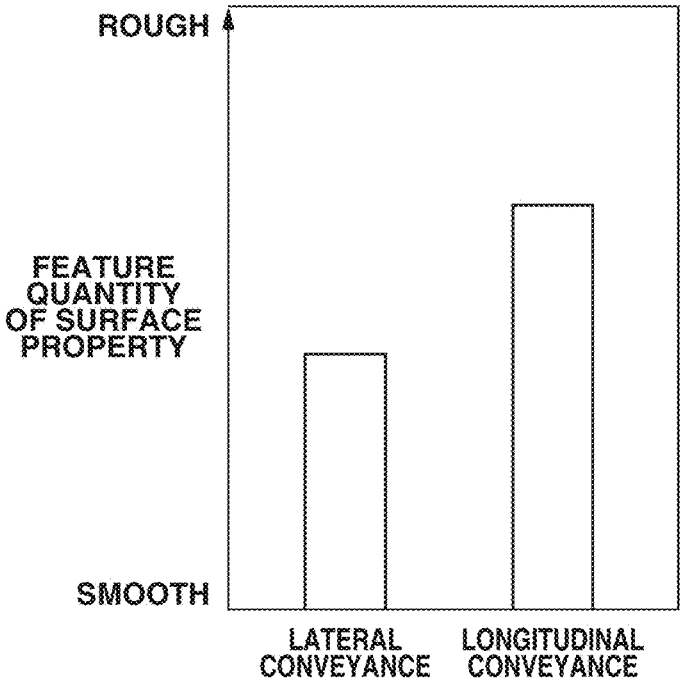
FIGS. 29A and 29B illustrate differences of feature quantities in a lateral conveyance state and a longitudinal conveyance state.

Next, FIG. 29A illustrates feature quantities obtained by detecting a predetermined type of recording paper P by the surface property detection unit 320. Although the same type of recording paper P, the feature quantities are different by the orientation of the recording paper P (the longitudinal conveyance and the lateral conveyance). If the type of the recording paper P is determined using this result as it is, and the image forming condition is determined, there is a possibility that different image forming conditions are applied to the same type of recording papers P. In addition, there is a possibility that the image forming condition suitable for the property of the recording paper P cannot be set, and the image quality is lowered.

Figure 29B:
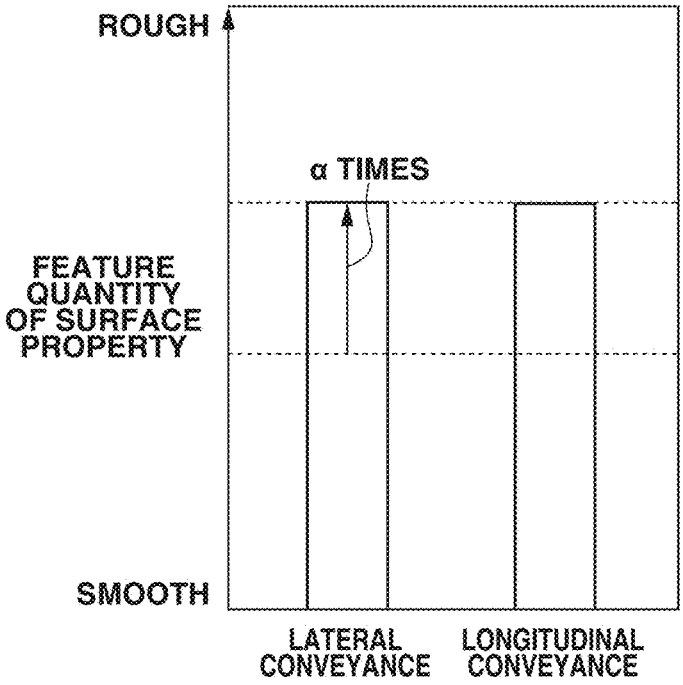

Thus, according to the present exemplary embodiment, the feature quantity is corrected according to the orientation of the recording paper P detected by the above described regulating plates 50*a*, 50*b*, and 51 included in the cassette 200*a*. FIG. 29B illustrates the relevant state. For example, when the longitudinal conveyance is used as the reference, the feature quantity obtained in the case of the lateral conveyance is corrected by being multiplied by a constant rate ($\alpha$) or the like. Accordingly, even in the case of the lateral conveyance, the surface property can be regarded as equivalent to that of the longitudinal conveyance.

Figure 30:
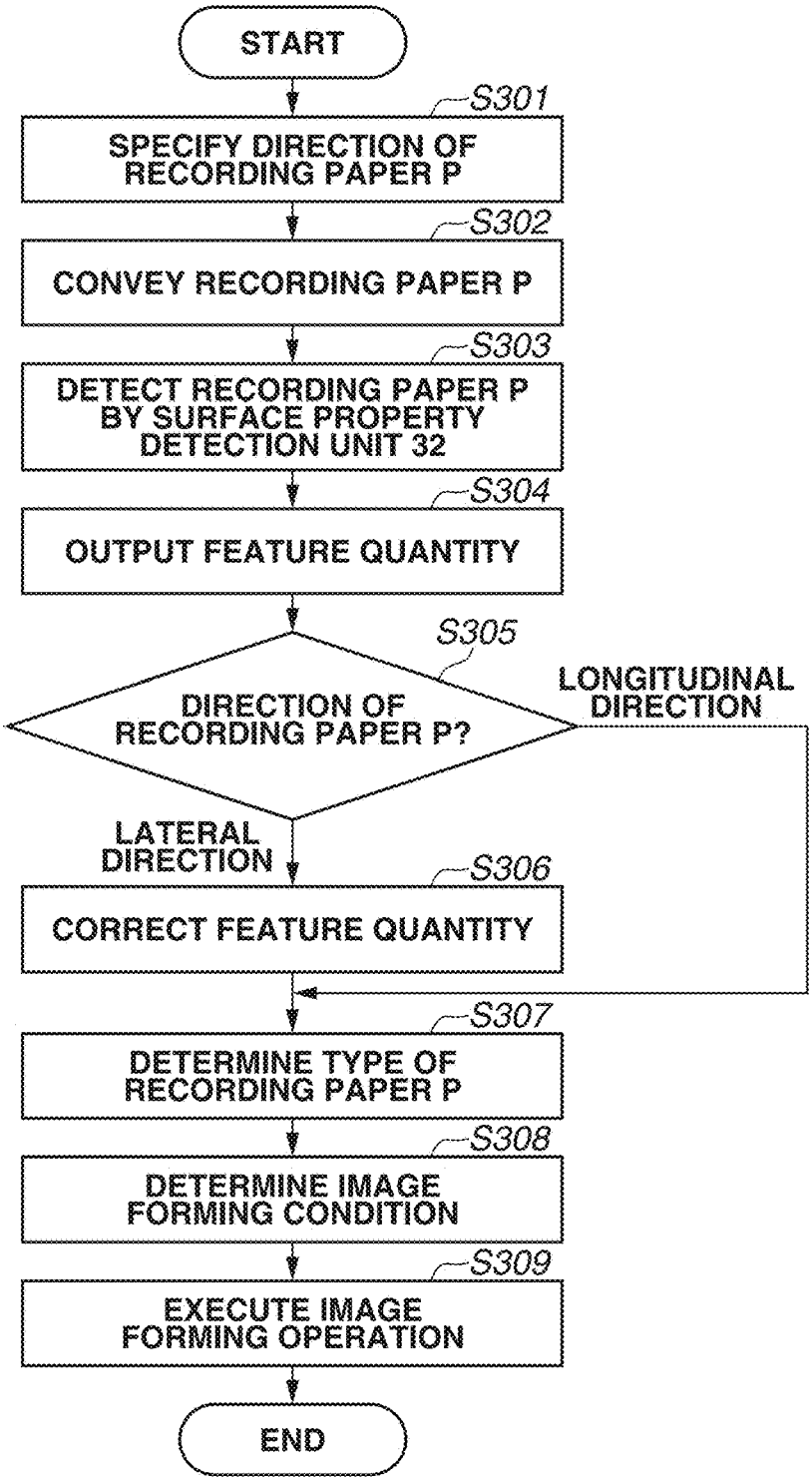
FIG. 30 is a flowchart according to the fourth exemplary embodiment.

The specific control method is illustrated in a flowchart in FIG. 30. The control based on the flowchart in FIG. 30 is executed by the control unit 300 and the sensor control unit 301 based on a program stored in the ROM 90.

When the image forming unit forms an image on the recording paper P, first, in step S301, the control unit 300 specifies the orientation of the recording paper P by the regulating plates 50*a*, 50*b*, and 51 included in the cassette 200*a*. Next, in step S302, the control unit 300 causes the sheet feed roller 400*a* and others to feed and convey the recording paper P from the cassette 200*a*. In step S303, the sensor control unit 301 causes the surface property detection unit 320 to detect the recording paper P. In step S304, the sensor control unit 301 calculates and outputs the feature quantity from the detection result of the surface property detection unit 320. Further, in step S305, the control unit 300 determines whether the orientation of the recording paper P specified in step S301 is the longitudinal conveyance or the lateral conveyance. In the case of the lateral conveyance, in step S306, the sensor control unit 301 corrects the calculated feature quantity. On the other hand, in the case of the longitudinal conveyance, the sensor control unit 301 does not correct the calculated feature quantity. In step S307, the sensor control unit 301 determines the type of the recording paper P based on the such obtained feature quantity. Next, in step S308, the control unit 300 determines the image forming condition of the image forming unit based on the determined type. In step S309, the control unit 300 causes the image forming unit to form an image on the recording paper P under the determined image forming condition. Then, the processing in the flowchart is terminated.

As described above, according to the present exemplary embodiment, the orientation of the recording paper P can be specified by the regulating plates 50*a*, 50*b*, and 51 included in the cassette 200*a*. Accordingly, the type of the recording paper P can be determined with high accuracy regardless of the longitudinal conveyance or the lateral conveyance. In addition, there is no need to install two pieces of the LED light sources 41 as the illumination units, and the cost can be suppressed. Therefore, according to the present exemplary embodiment, the image forming apparatus can be provided which can determine a type of a recording material with high accuracy and form a high quality image while suppressing influence of a fiber direction of the recording material without increasing a cost.

According to the present exemplary embodiment, the configuration which includes both of the side regulating plates 50*a* and 50*b* and the trailing edge regulating plate 51, however, the present invention is not limited to this configuration. A configuration which includes either one of the regulating plates may be adopted as long as the orientation of the recording paper P can be detected.

Further, according to the present exemplary embodiment, the control is described which is performed when the recording paper P is fed from the cassette 200*a*, however, the present invention is not limited to the above-described one. The control of the present exemplary embodiment can be applied to a case when the recording paper P is fed from the tray 200*b*. However, it is assumed that the tray 200*b* includes the side regulating plates 50*a* and 50*b* and the trailing edge regulating plate 51.

A method for determining a type of the recording paper P according to a fifth exemplary embodiment is described. The descriptions of the main parts are similar to those in the fourth exemplary embodiment, and only parts different from the fourth exemplary embodiment are described here. According to the fourth exemplary embodiment, the cassette 200*a* includes the regulating plates 50*a*, 50*b*, and 51, and the orientation of the recording paper P is specified by detecting positions of the regulating plates. According to the present exemplary embodiment, the registration sensor 600 disposed on a conveyance path detects a length of the recording paper P in the conveyance direction, and the orientation of the recording paper P is specified based on the detected length.

Figure 31:
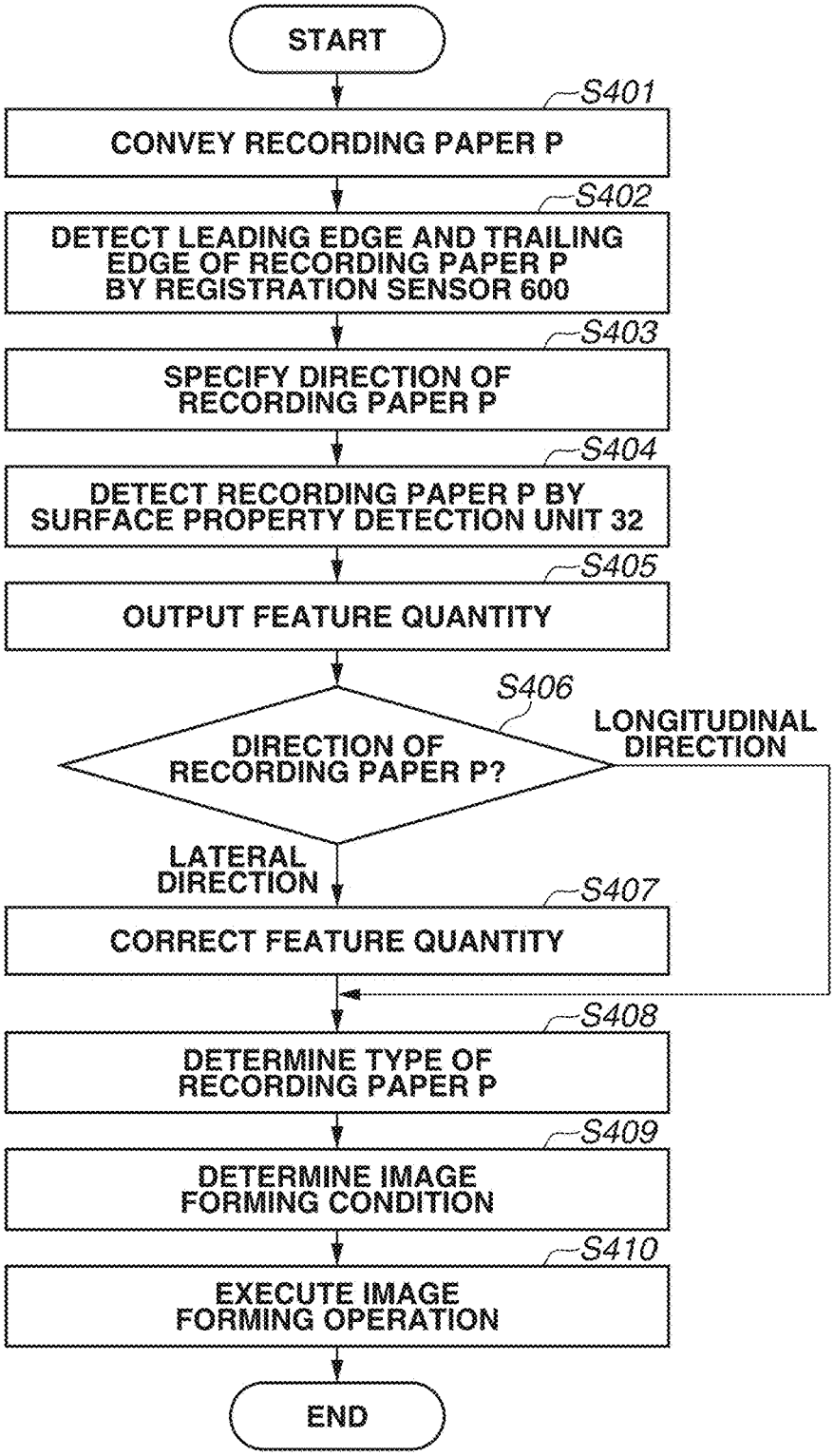
FIG. 31 is a flowchart according to the fifth exemplary embodiment.

A flowchart according to the present exemplary embodiment is illustrated in FIG. 31. Control based on the flowchart in FIG. 31 is executed by the control unit 300 and the sensor control unit 301 based on a program stored in the ROM 90.

When the image forming unit forms an image on the recording paper P, first, in step S401, the control unit 300 feeds and conveys the recording paper P from the cassette 200*a* by the sheet feed roller 400*a* and the like. In step S402, the control unit 300 calculates a length of the recording paper P in the conveyance direction from timings when the registration sensor 600 detects the leading edge and the trailing edge of the recording paper P and the conveyance speed of the recording paper P. The leading edge is an edge portion on the downstream side in the conveyance direction of the recording paper P, and the trailing edge is an edge portion on an upstream side in the conveyance direction of the recording paper P. In step S403, the control unit 300 specifies the orientation of the recording paper P based on the calculated length. Next, in step S404, the sensor control unit 301 causes the surface property detection unit 320 to detect the recording paper P. In step S405, the sensor control unit 301 calculates and outputs the feature quantity from the detection result of the surface property detection unit 320. Further, in step S406, the control unit 300 determines whether the orientation of the recording paper P specified in step S403 is the longitudinal conveyance or the lateral conveyance. In the case of the lateral conveyance, in step S407, the sensor control unit 301 corrects the calculated feature quantity. On the other hand, in the case of the longitudinal conveyance, the sensor control unit 301 does not correct the calculated feature quantity. In step S408, the sensor control unit 301 determines the type of the recording paper P based on the such obtained feature quantity. Next, in step S409, the control unit 300 determines the image forming condition of the image forming unit based on the determined type. In step S410, the control unit 300 causes the image forming unit to form an image on the recording paper P under the determined image forming condition. Then, the processing in the flowchart is terminated.

As described above, according to the present exemplary embodiment, the orientation of the recording paper P can be specified even in the configuration in which the cassette 200*a* is not provided with a mechanism for detecting a size and an orientation of the recording paper P. Thus, the image forming apparatus can be provided which can determine a type of a recording material with high accuracy and form a high quality image while suppressing influence of a fiber direction of the recording material without increasing a cost.

According to the fourth and the fifth exemplary embodiments, there is a case that the orientation of the recording paper P cannot be uniquely determined if the length of the recording paper P in the width direction or the length of the recording paper P in the conveyance direction is only detected. In such a case, the orientation of the recording paper P may be specified by combining the fourth exemplary embodiment and the fifth exemplary embodiment. For example, it is assumed that the cassette 200*a* is provided with only the side regulating plates 50*a* and 50*b* and not provided with the trailing edge regulating plate 51. In this configuration, the side regulating plates 50*a* and 50*b* can detect only a length of the recording paper P in the width direction, so that the orientation of the recording paper P cannot be specified in some cases. Thus, the registration sensor 600 additionally detects the length of the recording paper P in the conveyance direction, and thus the size and the orientation of the recording paper P can be specified.

According to the above-described exemplary embodiments, the control unit 300 determines the type of the recording paper P and determines the image forming condition according to the determined type. In this regard, the type of the recording paper P represents the classification such as a rough paper, a plain paper, and a gloss paper, and in more detail, represents the brand of the recording paper P, such as GF-600 (the plain paper), as described above. However, the present invention is not limited to the above-described configuration. The control unit 300 may determine the relative fiber direction of the recording paper P as the type of the recording paper P and determine the image forming condition according to the determined fiber direction.

The relative fiber direction is a fiber direction with respect to the conveyance direction of the recording paper P which has a different meaning from a fiber direction inherent in each brand. In other words, when the long grain recording paper P is longitudinally conveyed and when the short grain recording paper P is laterally conveyed, the fiber direction is parallel to the conveyance direction of the recording paper P in both cases, and it is regarded that these two cases have relatively the same fiber directions.

The image forming condition determined according to the relative fiber direction includes, for example, the fixing temperature. The relative fiber direction of the recording paper P can be roughly divided into two directions. One is a fiber direction parallel to the conveyance direction of the recording paper P, and the other is a fiber direction orthogonal to the conveyance direction of the recording paper P. It is generally known that the recording paper P having the fiber direction orthogonal to its conveyance direction easily curls compared to the recording paper P having the fiber direction parallel to its conveyance direction and easily winds around the fixing device 210. Therefore, when the image forming condition is determined, it is desirable that the fixing temperature of the recording paper P having the fiber direction orthogonal to its conveyance direction is set lower compared to that of the recording paper P having the fiber direction parallel to its conveyance direction so as to suppress the curl of the recording paper P.

Further, according to the above-described exemplary embodiments, the configuration is described in which the printer 100 automatically determines the orientation of the recording paper P. However, the present invention is not limited to the above-described configuration. A configuration may be adopted in which a user can input a size and an orientation of the recording paper P via a not-illustrated operation panel (an input unit) disposed on the printer 100. Alternatively, a configuration may be adopted in which a user can perform input from a personal computer (an external device) connected to the printer 100 via a driver. A user can issue an image forming instruction from the personal computer to the printer 100 via the driver.

Further, the orientation of the recording paper P may be specified by combining information input by a user and information obtained from the configuration according to the fourth exemplary embodiment or the fifth exemplary embodiment. For example, it is assumed that only size information of the recording paper P is notified from a user, and an orientation is unclear. In this case, if the cassette 200*a* is provided with at least either one of the side regulating plates 50*a* and 50*b* and the trailing edge regulating plate 51, and a length in the width direction of the recording paper P or the conveyance direction can be detected, the orientation of the recording paper P can be specified.

Further, according to the above-described exemplary embodiments, the control is described in which correction is performed in the case of the lateral conveyance, however, the present invention is not limited to the above-described one. Control for performing correction in the case of the longitudinal conveyance may be adopted. In addition, control for performing correction in either of the lateral conveyance and the longitudinal conveyance may be adopted. In other words, it is only necessary that the same feature quantity can be obtained from the same type of the recording paper P even in the lateral conveyance or the longitudinal conveyance.

Further, according to the above-described exemplary embodiments, the control is described in which correction of the feature quantity is performed according to the orientation of the recording paper P, however, the present invention is not limited to the above-described one. Control may be adopted in which a determination table for the lateral conveyance and a determination table for the longitudinal conveyance are stored in the ROM 90, and which table is used may be selected according to the orientation of the recording paper P. Alternatively, a table stored in the ROM 90 may be one, and a threshold value included in the table may be corrected according to the orientation of the recording paper P. The above-described control corresponds to correction (determination) of a rule for determining the type of the recording paper P.

Further, according to the above-described exemplary embodiments, the surface property detection unit 320 is fixedly installed in the printer 100, however, the surface property detection unit 320 may have a configuration detachably attachable to the printer 100. If the surface property detection unit 320 has a detachably attachable configuration, for example, when the surface property detection unit 320 breaks down, a user can easily change the detection unit. Alternatively, the surface property detection unit 320 may simply have a configuration which can be additionally attached to the printer 100.

Further, according to the above-described exemplary embodiments, the surface property detection unit 320 and the sensor control unit 301 may be unified as a recording material determination apparatus and have a configuration detachably attachable to the printer 100. If the surface property detection unit 320 and the sensor control unit 301 are unified and exchangeable as described above, when a function of the surface property detection unit 320 is updated and added, a user can easily exchange to a sensor having the new function. Alternatively, the surface property detection unit 320 and the sensor control unit 301 may be simply unified and have a configuration which can be additionally attached to the printer 100.

Further, according to the above-described exemplary embodiments, a laser beam printer is exemplified, however, an image forming apparatus to which the present invention is applied is not limited to the laser beam printer and may be a printer using other printing methods, such as an ink jet printer, or a copying machine.

While exemplary embodiments have been described, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-226904, filed Nov. 19, 2015, No. 2015-226905, filed Nov. 19, 2015, and No. 2016-178611, filed Sep. 13, 2016, which are hereby incorporated by reference herein in their entirety.

What is claimed is:

1. An image forming apparatus comprising:

an image forming unit configured to form an image on a recording material;

only a single light source configured to emit light;

an image capturing unit configured to capture light emitted by the single light source and reflected by the recording material as a surface image including a plurality of pixels; and a control unit configured to obtain a first feature quantity from differences among output values of a plurality of pixels arranged in a first direction out of the plurality of pixels included in the surface image captured by the image capturing unit, and obtain a second feature quantity from differences among output values of a plurality of pixels arranged in a second direction intersecting the first direction out of the plurality of pixels included in the surface image used to obtain the first feature quantity, determine a fiber direction with respect to a conveyance direction of the recording material by comparing the first feature quantity with the second feature quantity, and control an image forming condition of the image forming unit based on the determined fiber direction.

2. The image forming apparatus according to claim 1, wherein a plurality of pixels respectively exist on a first line and a second line parallel to the first direction in the surface image captured by the image capturing unit, and a plurality of pixels respectively exist on a third line and a fourth line parallel to the second direction in the surface image captured by the image capturing unit, and wherein the control unit obtains the first feature quantity by integrating a variation of output values of the plurality of pixels arranged on the first line and a variation of output values of the plurality of pixels arranged on the second line, and obtains the second feature quantity by integrating a variation of output values of the plurality of pixels arranged on the third line and a variation of output values of the plurality of pixels arranged on the fourth line.

3. The image forming apparatus according to claim 2, wherein a first pixel, a second pixel, and a third pixel sequentially arranged in order exist on each of the first line, the second line, the third line, and the fourth line in the surface image captured by the image capturing unit, and wherein the control unit obtains an absolute value of a difference between an output value of the first pixel and an output value of the second pixel, obtains an absolute value of a difference between the output value of the second pixel and an output value of the third pixel, and obtains the variation of the output values of the plurality of pixels arranged on each of the first line, the second line, the third line, and the fourth line by integrating the absolute values of the two differences.

4. The image forming apparatus according to claim 2, wherein the control unit obtains a maximum value and a minimum value from among output values of the plurality of pixels arranged on each of the first line, the second line, the third line, and the fourth line and obtains the variation of the output values of the plurality of pixels arranged on each of the first line, the second line, the third line, and the fourth line by calculating an absolute value of a difference between the maximum value and the minimum value.

5. The image forming apparatus according to claim 1, wherein the control unit determines the fiber direction with respect to the conveyance direction of the recording material based on a ratio of the first feature quantity and the second feature quantity.

6. The image forming apparatus according to claim 1, wherein the first direction and the second direction are orthogonal to each other.

7. The image forming apparatus according to claim 6, wherein the first direction is a direction parallel to the conveyance direction of the recording material and the second direction is a direction orthogonal to the conveyance direction of the recording material.

8. The image forming apparatus according to claim 1, further comprising:

a loading unit configured to load a recording material therein; and a regulating plate configured to regulate a position of the recording material loaded in the loading unit, wherein the control unit detects a size and an orientation of the recording material loaded in the loading unit from a position of the regulating plate, and controls the image forming condition based on the determined fiber direction, and the detected size and orientation of the recording material.

9. The image forming apparatus according to claim 1, wherein the image forming condition is a fixing temperature when a fixing unit included in the image forming unit fixes an image on the recording material.

10. The image forming apparatus according to claim 9, wherein the control unit sets a lower fixing temperature for fixing the image on the recording material having the fiber direction orthogonal to the conveyance direction of the recording material as compared with that of the recording material having the fiber direction parallel to the conveyance direction.

11. The image forming apparatus according to claim 1, wherein the control unit determines that the fiber direction with respect to the conveyance direction of the recording material is the second direction in a case where the first feature quantity is larger than the second feature quantity, and determines that the fiber direction with respect to the conveyance direction of the recording material is the first direction in a case where the second feature quantity is larger than the first feature quantity.

12. A recording material determination apparatus comprising:

a single light source configured to emit light;

an image capturing unit configured to capture light emitted by the single light source and reflected by a recording material as a surface image including a plurality of pixels; and a control unit configured to obtain a first feature quantity from differences among output values of a plurality of pixels arranged in a first direction out of the plurality of pixels included in the surface image captured by the image capturing unit, and obtain a second feature quantity from differences among output values of a plurality of pixels arranged in a second direction intersecting the first direction out of the plurality of pixels included in the surface image used to obtain the first feature quantity, and determine a fiber direction with respect to a conveyance direction of the recording material by comparing the first feature quantity with the second feature quantity.

13. An image forming apparatus comprising:

an image forming unit configured to form an image on a recording material;

a single light source configured to emit light;

an image capturing unit configured to capture light emitted by the single light source and reflected by the recording material as a surface image including a plurality of pixels; and a control unit configured to obtain a first feature quantity by integrating absolute values of differences between output values of adjacent pixels in a first direction out of the plurality of pixels included in the surface image captured by the image capturing unit and obtain a second feature quantity by integrating absolute values of differences between output values of adjacent pixels in a second direction intersecting the first direction out of the plurality of pixels included in the surface image used to obtain the first feature quantity, and configured to control an image forming condition of the image forming unit based on the obtained first feature quantity and the obtained second feature quantity.

14. The image forming apparatus according to claim 13, wherein the control unit controls the image forming condition based on an average, a ratio, or a difference of the first feature quantity and the second feature quantity.

15. The image forming apparatus according to claim 13, wherein the first direction and the second direction are orthogonal to each other.

16. The image forming apparatus according to claim 15, wherein the first direction is a direction parallel to a conveyance direction of the recording material and the second direction is a direction orthogonal to the conveyance direction of the recording material.

17. The image forming apparatus according to claim 13, further comprising:

a loading unit configured to load a recording material therein; and a regulating plate configured to regulate a position of the recording material loaded in the loading unit, wherein the control unit detects a size and an orientation of the recording material loaded in the loading unit from a position of the regulating plate, and controls the image forming condition based on the obtained first feature quantity, the obtained second feature quantity, and the detected size and orientation of the recording material.

18. The image forming apparatus according to claim 13, wherein the image forming condition is a conveyance speed of the recording material, a voltage value to be applied to a transfer unit included in the image forming unit, or a fixing temperature when a fixing unit included in the image forming unit fixes an image on the recording material.

19. The image forming apparatus according to claim 13, wherein the control unit determines a type of the recording material based on the obtained first feature quantity and the obtained second feature quantity, and controls the image forming condition of the image forming unit based on the determined type.

20. The image forming apparatus according to claim 19, wherein the type of the recording material is a surface property of the recording material.

* * * * *